US011772752B1

(12) United States Patent
Lobisser

(10) Patent No.: US 11,772,752 B1
(45) Date of Patent: Oct. 3, 2023

(54) ENHANCED MAST ASSEMBLY FOR HYDROFOIL WATERSPORTS BOARD SYSTEM

(71) Applicant: Adherend Innovations, Inc., Bainbridge Island, WA (US)

(72) Inventor: G. Kyle Lobisser, Bainbridge Island, WA (US)

(73) Assignee: Adherend Innovations, LLC, Bainbridge Island, WA (US)

( * ) Notice: Subject to any disclaimer, the term of this patent is extended or adjusted under 35 U.S.C. 154(b) by 0 days.

(21) Appl. No.: 18/121,188

(22) Filed: Mar. 14, 2023

(51) Int. Cl.
*B63B 32/60* (2020.01)
*B63B 1/24* (2020.01)
*B63B 32/66* (2020.01)

(52) U.S. Cl.
CPC ..... *B63B 32/60* (2020.02); *B63B 1/248* (2013.01); *B63B 32/66* (2020.02)

(58) Field of Classification Search
CPC ..... B63B 1/242; B63B 1/246; B63B 1/248; B63B 32/10; B63B 32/00; B63B 32/60; B63B 32/62; B63B 32/64; B63B 32/66; B63B 34/45
See application file for complete search history.

(56) References Cited

U.S. PATENT DOCUMENTS 2,144,688 A * 1/1939 Riede ..... A63C 11/22 280/824
2,818,290 A * 12/1957 Harocopo ..... G05G 5/06 403/108
3,101,291 A * 8/1963 Lalick ..... A47G 33/06 428/7
4,501,214 A * 2/1985 Meyer ..... B63H 8/24 114/90
10,358,193 B2 7/2019 Lobisser
2022/0388607 A1* 12/2022 Rosen ..... B63B 1/28

FOREIGN PATENT DOCUMENTS

BR 202015031577 U2 * 6/2017

* cited by examiner

*Primary Examiner* — Ajay Vasudeva
(74) *Attorney, Agent, or Firm* — Grandview Law

(57) ABSTRACT

A mast assembly for a hydrofoil watersports board system includes a mast, a fuselage adapter, and a watersports board mount. The mast has a fuselage end coupled with the fuselage adapter and a board end coupled with the watersports board mount. The mast includes a side profile having width dimensions in portions of the mast that are greater than at its fuselage end and its board end. The fuselage adapter couples to a fuselage of a lower assembly, which further includes a front wing and a tail wing. The watersports board mount couples to a watersports board. The mast includes internally integral stringers to improve structural integrity.

23 Claims, 38 Drawing Sheets

ENHANCED MAST ASSEMBLY FOR HYDROFOIL WATERSPORTS BOARD SYSTEM

SUMMARY

In one or more aspects a mast for a hydrofoil watersports board system including (I) a first end; (II) a second end; (III) at least one length dimension extending between the first end and the second end; (IV) a plurality of width dimensions extending orthogonal to the length dimension, the plurality of width dimensions being smaller than the at least one length dimension; and (V) at least one thickness dimension extending orthogonal to the length dimension and orthogonal to the plurality of width dimensions, the at least one thickness dimension being smaller than the plurality of width dimensions; wherein the at least one length dimension includes a first length dimension and the plurality of width dimensions includes a first width dimension, a second width dimension, and a third width dimension, wherein the first width dimension being positioned less than a first length percentage of the first length dimension from the first end, wherein the second width dimension being positioned less than a second length percentage of the first length dimension from the second end, wherein the third width dimension being positioned greater than a third length percentage of the first length dimension from the first end and from the second end, wherein the third width dimension being greater than the first width dimension by at least a first width percentage of the first width dimension, and wherein the third width dimension being greater than the second width dimension by at least a second width percentage of the second width dimension. Wherein the first length percentage being at least 25%, the second length percentage being at least 25%, and the third length percentage being at least 25%. Wherein the plurality of width dimensions includes a maximum width dimension being greater than any other of the plurality of width dimensions, the maximum width dimension being positioned from the first end and the second end at least the third length percentage. Wherein the at least one length dimension being greater than 49 cm and less than 151 cm, the plurality of width dimensions being greater than 89 mm and less than 151 mm, and the at least one thickness dimension being greater than 9 mm and less than 21 mm. Wherein the first width percentage of the first width dimension being at least 5%, and the second width percentage of the second width dimension being at least 5%. Wherein the first width percentage of the first width dimension being no greater than 75%, and the second width percentage of the second width dimension being no greater than 75%. Wherein the at least one thickness dimension includes a minimum thickness dimension being smaller than any other of the at least one thickness dimension, the minimum thickness dimension being positioned from the first end and the second end at least 15% of the first length dimension. Wherein the at least one thickness dimension includes a minimum thickness dimension being smaller than any other of the at least one thickness dimension, the plurality of width dimensions includes a maximum width dimension being greater than any other of the plurality of width dimensions and positioned at one or more locations along the at least one length dimension, and the maximum width dimension being positioned at least as close as being adjacent to the minimum thickness dimension. Wherein the at least one thickness dimension includes a maximum thickness dimension being greater than any other of the at least one thickness dimension, and the maximum thickness dimension being located at least one of the following positions along the first length dimension: at least as close as being adjacent to the first end, at least as close as being adjacent to the second end, and at least as close as being adjacent to the first end and the second end. Wherein the mast is of at least one construction taken from the following list: single-piece construction, hydroformed construction, extruded construction, aluminum construction, pressed construction, molded construction, and carbon construction. Further including at least one internal cavity, the internal cavity including at least one interior surface wall, and at least one stringer extending from a first of the at least one interior surface wall without extending from any other of the at least one interior surface wall, the at least one stringer extending at least partially along the at least one length dimension. Wherein the mast includes at least one edge with at least one side profile, the plurality of width dimensions includes a maximum width dimension being greater than any other of the plurality of width dimensions, the plurality of width dimensions includes a minimum width dimension being smaller than any other of the plurality of width dimensions, the minimum width dimension positioned closer to the first end than the maximum width dimension is positioned, the minimum width dimension positioned closer to the second end than the maximum width dimension is positioned, the plurality of width dimensions includes a portion of the plurality of width dimensions positioned along the length dimension between the maximum width dimension and the minimum width dimension, and the portion of plurality of width dimensions forming a portion of the at least one side profile along at least one edge of the mast, wherein the at least one edge of the mast is at least one of the following: a trailing edge and a leading edge. Wherein the at least one side profile along the at least one edge of the mast includes is at least one portion of the following portions: at least one linear portion and at least one curvilinear portion.

In one or more aspects a mast assembly for a hydrofoil watersports board system including (I) a single-piece metallic mast including (A) at least one internal cavity, (B) a first end, including a first opening providing external access to a first internal cavity of the at least one internal cavity, (C) a second end, and (D) a plurality of dimensions including a length dimension, the length dimension extending between the first end and the second end, the length dimension being greater than any other of the plurality of dimensions; and (II) a metallic insert shaped and sized to be press-fit into a portion of the first internal cavity through the first opening, the metallic insert fully blocking the external access to the first internal cavity from the first opening when the metallic insert is press-fit into the portion of the first internal cavity through the first opening. Further including at least one threaded fastener, wherein the metallic insert includes at least one threaded hole, wherein the at least one threaded fastener being shaped and sized to couple with the at least one threaded hole, and wherein the at least one threaded fastener includes at least one stainless steel screw. Further including at least one non-threaded fastener, wherein the metallic insert includes at least one non-threaded hole, wherein the at least one non-threaded fastener being shaped and sized to couple with the at least one non-threaded hole, and wherein the at least one non-threaded fastener includes at least one stainless steel dowel pin. Wherein the metallic insert being without a flange, the metallic insert being flush with the first end when the metallic insert is press-fit into the portion of the first internal cavity through the first opening of the mast. Wherein the single-piece mast is of at least one construction taken from the following list: hydro-formed construction, extruded construction, aluminum construction, and pressed construction.

In one or more aspects a mast for a hydrofoil watersports board system including (A) a first end; (B) a second end positioned opposite from the first end along a length dimension; (C) a plurality of dimensions including the length dimension, the length dimension extending between the first end and the second end, the length dimension being greater than any other of the plurality of dimensions; (D) an internal cavity including a first interior surface and an opposingly facing second interior surface, the first interior surface and the second interior surface extending along the length dimension; (E) at least one first stringer extending from the first interior surface without extending from the second interior surface, the at least one first stringer extending at least partially along the length dimension; and (F) at least one second stringer extending from the second interior surface without extending from the first interior surface, the at least one second stringer extending at least partially along the length dimension. Wherein the at least one stringer is positioned at least 25 mm from the first end and from the second end. Wherein the mast is of a construction chosen from the following: single-piece construction, extruded aluminum construction, and pressed aluminum construction.

In one or more aspects a mast assembly including (I) a mast including (A) a first end including an exterior surface, and (B) a second end being positioned along a longitudinal direction from the first end; and (II) at least one non-threaded dowel pin sized and shaped to couple with a portion of the mast assembly, a portion of the at least one non-threaded dowel pin being extended past the exterior surface of the first end in the longitudinal direction opposite and away from the second end when the non-threaded dowel pin is being coupled with the portion of the mast assembly. Further including a metallic insert, the portion of the mast assembly being the metallic insert, wherein the first end of the mast includes a cavity opening and wherein the metallic insert being press-fit into the cavity opening of the first opening of the mast, the metallic insert including at least one non-threaded hole sized and shaped to couple with the at least one non-threaded dowel pin when the non-threaded dowel pin is being coupled with the portion of the mast assembly. Wherein the exterior surface of the first end includes at least one non-threaded hole sized as the portion of the mast assembly, the at least non-threaded hole sized and shaped to couple with the at least one non-threaded dowel pin when the non-threaded dowel pin is being coupled with the portion of the mast assembly. Wherein the at least one non-threaded dowel pin being of precision ground stainless steel manufacture. Wherein the mast includes a cavity including at least one interior surface, and wherein the mast includes one or more stringers extending from a first of the at least one interior surface, extending along the longitudinal direction, and being positioned at least 25 mm from the first end and the second end of the mast.

BRIEF DESCRIPTION OF THE FIGURES

For a more complete understanding of implementations, reference now is made to the following descriptions taken in connection with the accompanying drawings. The use of the same symbols in different drawings typically indicates similar or identical items, unless context dictates otherwise.

With reference now to the figures, shown are one or more examples of a mast assembly for hydrofoil watersports board system, articles of manufacture, compositions of matter for same that may provide context, for instance, in introducing one or more implementations described herein.

DETAILED DESCRIPTION

Figure 1:
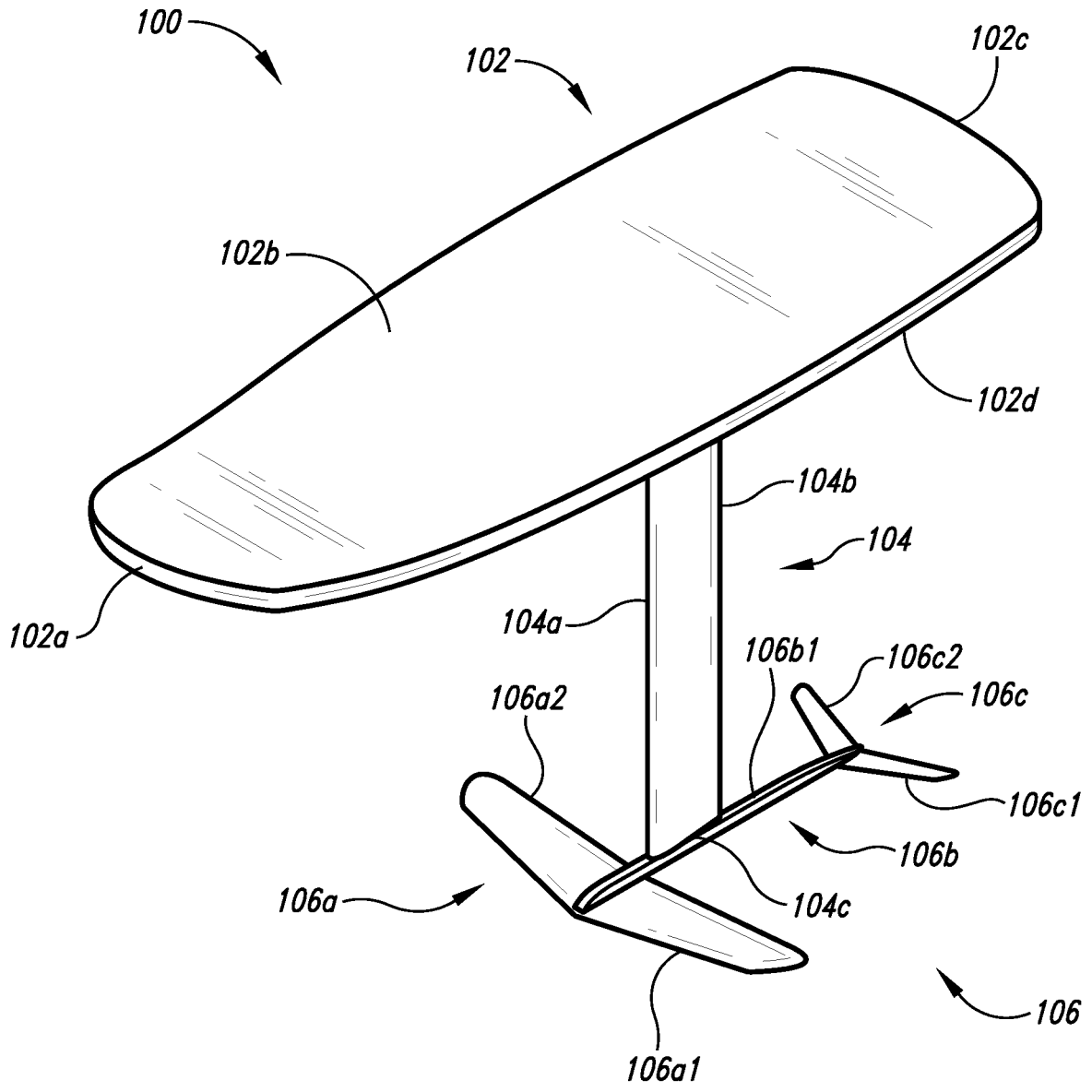
Fig. 1 (Prior Art)
FIG. 1 is a front perspective view of a conventional hydrofoil watersports board system.

In the following detailed description, reference is made to the accompanying drawings, which form a part hereof. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here.

Turning to FIG. 1, depicted therein is a front perspective view of hydrofoil watersports board system 100. In implementations, hydrofoil watersports board system 100 is shown to include watersports board 102, hydrofoil mast 104, and lower assembly 106. In implementations, watersports board 102 is shown to include leading edge 102*a*, upper surface 102*b*, trailing edge 102*c*, and bottom surface 102*d*. In implementations, hydrofoil mast 104 is shown to include leading portion 104*a*, trailing portion 104*b*, fuselage end 104*c*, and board end 104*d*.

In implementations, lower assembly 106 is shown to include front wing 106*a*, fuselage 106*b*, tail wing 106*c*. In implementations, front wing 106*a* is shown to include leading edge 106*a*1, and trailing edge 106*a*2. In implementations, fuselage 106*b* is shown to include upper portion 106*b*1. In implementations, tail wing 106*c* is shown to include leading edge 106*c*1, and trailing edge 106*c*2.

Figure 2:
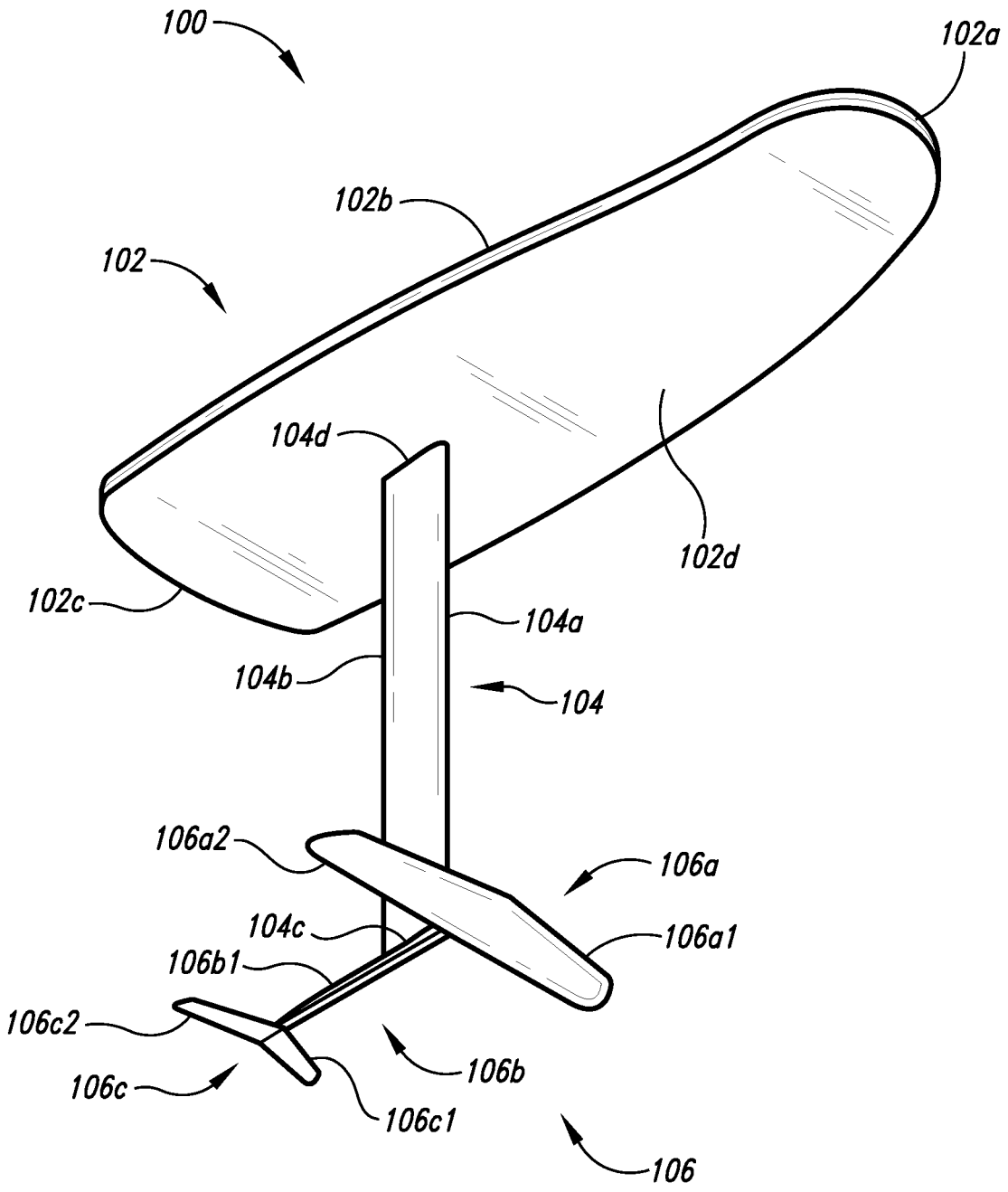
Fig. 2 (Prior Art)
FIG. 2 is a rear perspective view of the conventional hydrofoil watersports board system of FIG. 1.

Turning to FIG. 2, depicted therein is a rear perspective view of hydrofoil watersports board system 100.

Figure 3:
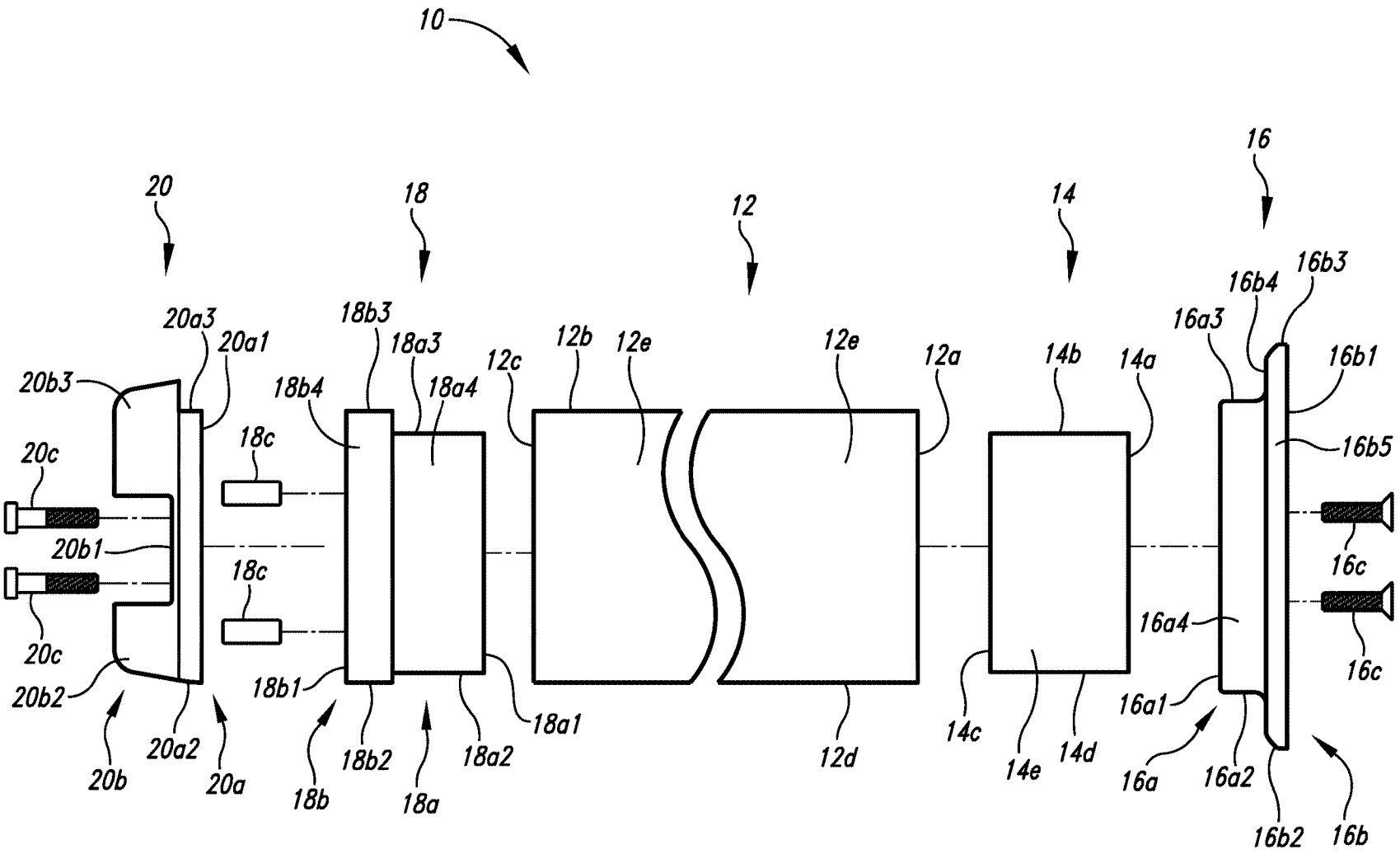
FIG. 3 is an exploded side elevational view of a mast assembly, watersports board mount, and fuselage adapter for a hydrofoil watersports board system.

Turning to FIG. 3, depicted therein is an exploded side elevational view of mast assembly 10, watersports board mount 16, and fuselage adapter 20. In implementations, mast assembly 10 is shown to include mast 12, watersports board mount insert 14, and fuselage adapter insert 18.

In implementations mast 12 is shown to include board end 12*a*, trailing edge 12*b*, fuselage end 12*c*, leading edge 12*d*, and side portion 12*e*. In implementations mast 12 can be of at least one construction taken from the following list: hydro-formed construction, extruded construction, aluminum construction, pressed construction, molded construction, and carbon construction. In implementations watersports board mount insert 14 and fuselage adapter insert 18 can be press-fit or bonded to mast 12. In implementations watersports board mount 16 and fuselage adapter 20 can be of different styles to match different styles of hydrofoil watersports board system 100 and lower assembly 106, respectively. In implementations watersports board mount insert 14 is shown to include board end 14*a*, trailing side 14*b*, and fuselage end 14*c*.

In implementations fuselage adapter insert 18 is shown to include insert portion 18*a*, flange portion 18*b*, and non-threaded dowel pin 18*c*. In implementations non-threaded dowel pin 18*c* can be slip-fit or press-fit into flange portion 18*b* or directly into mast 12 in other implementations to couple fuselage adapter 20 to mast 12 without use of fuselage adapter insert 18. In implementations non-threaded dowel pin 18*c* can be constructed from stainless steel by precision grinding or other construction process.

In implementations insert portion 18*a* is shown to include mast side 18*a*1, leading side 18*a*2, trailing side 18*a*3, and side portion 18*a*4. In implementations flange portion 18*b* is shown to include fuselage side 18*b*1, leading side 18*b*2, trailing side 18*b*3, and side portion 18*b*4.

In implementations watersports board mount 16 is shown to include receiver portion 16*a*, flange portion 16*b*, and threaded fastener 16*c*. In implementations threaded fastener 16*c* can be stainless steel screws or other threaded fasteners. In implementations receiver portion 16*a* is shown to include mast side 16*a*1, leading side 16*a*2, trailing side 16*a*3, and side portion 16*a*4. In implementations flange portion 16*b* is shown to include board side 16*b*1, leading side 16*b*2, trailing side 16*b*3, exterior side 16*b*4, and side portion 16*b*5.

In implementations, fuselage adapter 20 is shown to include mast coupler portion 20*a*, fuselage coupler portion 20*b*, threaded fastener 20*c*. In implementations threaded fastener 20*c* can be stainless steel screws or other threaded fastener. In implementations mast coupler portion 20*a* is shown to include mast side 20*a*1, leading side 20*a*2, and trailing side 20*a*3. In implementations fuselage coupler portion 20*b* is shown to include fastener portion 20*b*1, leading portion 20*b*2, and trailing portion 20*b*3.

Figure 4:
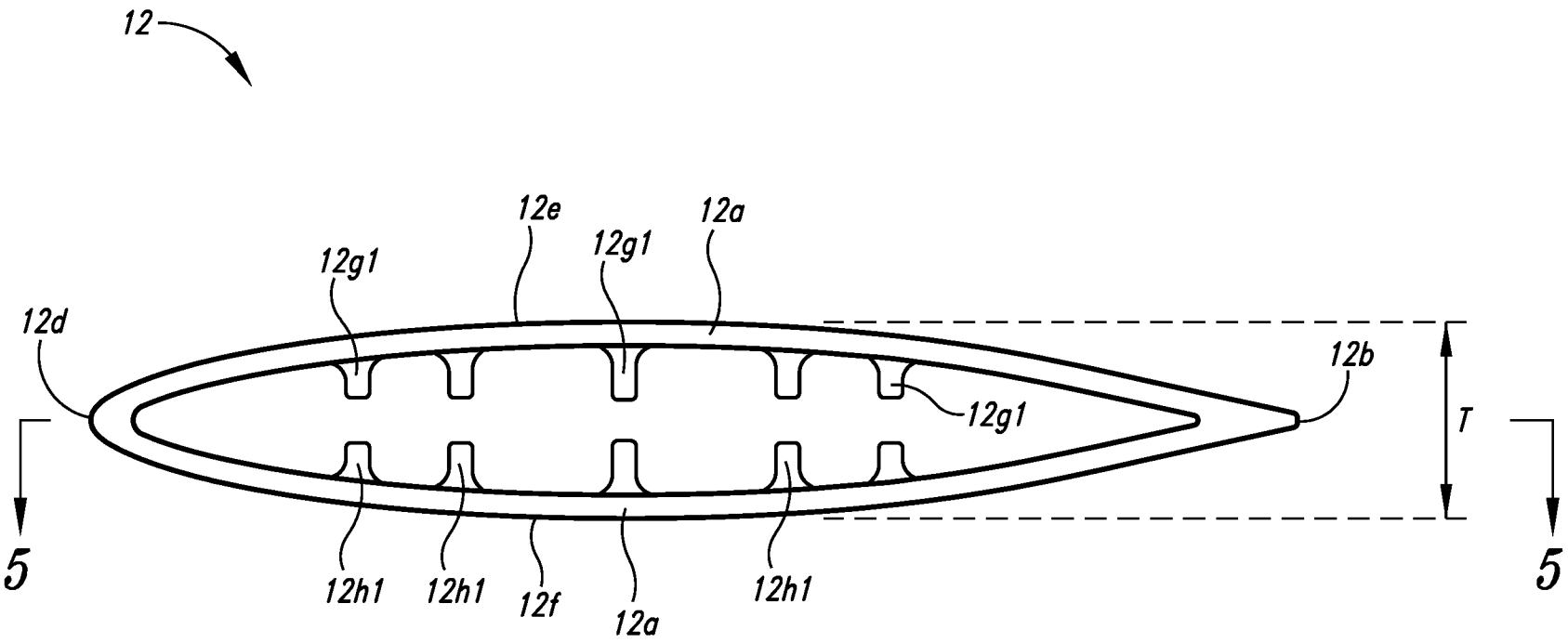
FIG. 4 is a top plan view of a mast of the mast assembly FIG. 3.

Turning to FIG. 4, depicted therein is a top plan view of mast 12. In implementations, mast 12 is shown to include side portion 12*f*, stringer 12*g*1, and stringer 12*h*1. In implementations, stringer 12*g*1, and stringer 12*h*1 are constructed to extend from side portion 12*e* and side portion 12*f*, respectively, without extending from side portion 12*f* and side portion 12*e*, respectively. In general, stringers are positioned to extend along the longitudinal direction of mast 12 to transfer internal loads including rider induced loads on mast 12 on to other portions of mast 12. In implementations, mast 12 is shown to include thickness dimension T. In implementations thickness dimension T of mast 12 can be greater than 9 mm and less than 21 mm. Maximum of thickness dimension T of mast 12 can occur at or near to board end 12*a* and/or fuselage end 12*c* of mast 12.

Figure 5:
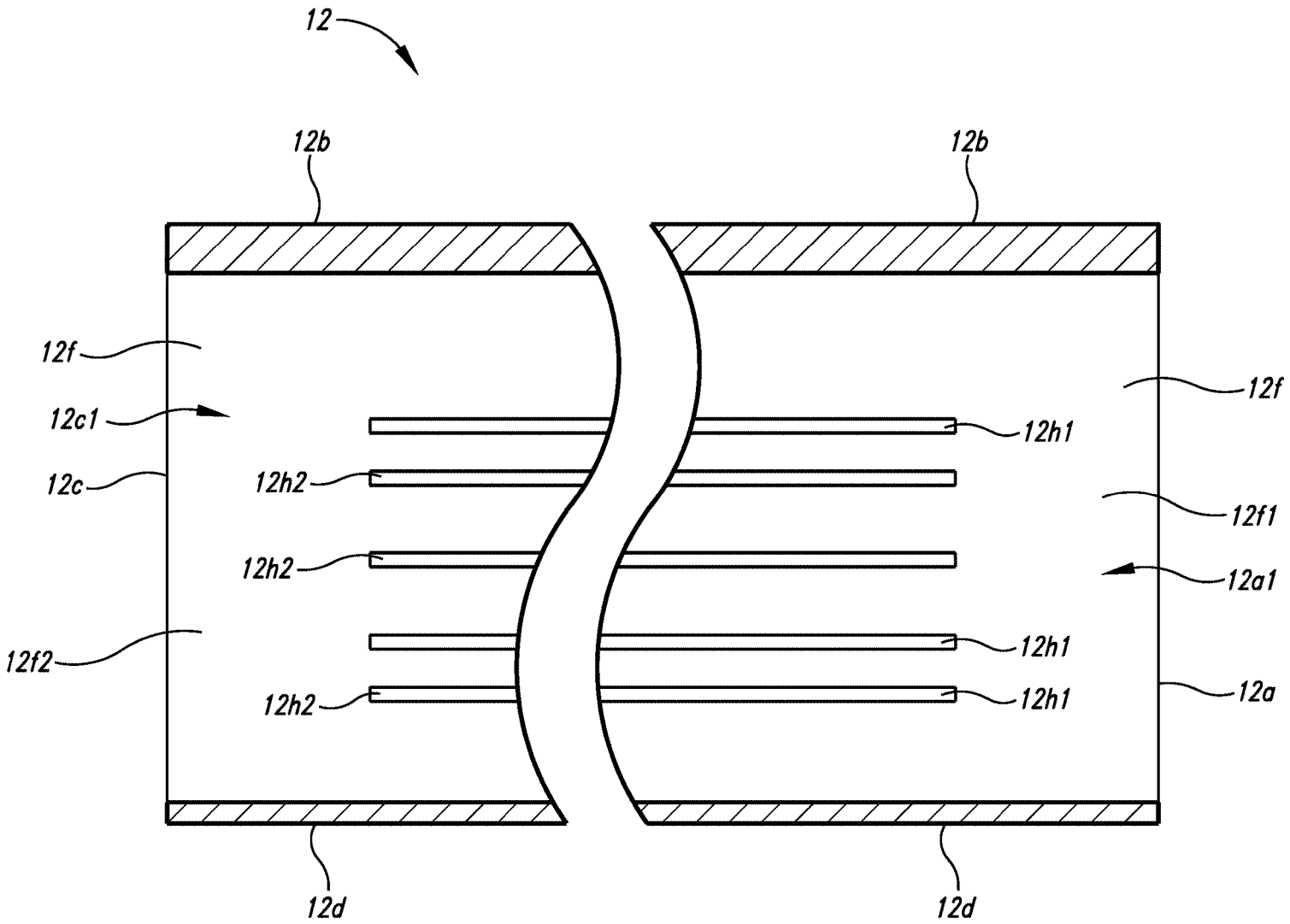
FIG. 5 is a cross-sectional elevational view of the mast of FIG. 3 taken along the 5-5 cut line of FIG. 4.

Turning to FIG. 5, depicted therein is a cross-sectional elevational view of mast 12 taken along the 5-5 cut line of FIG. 4. As shown, stringer 12*h*1 and stringer 12*h*2 are spaced from board end 12*a* and fuselage end 12*c*, respectively. In implementations this spacing can be at least 25 mm. In implementations stringer 12*h*1 and stringer 12*h*2 do not otherwise span the entire mast 12 as well, but in other implementations stringer 12*h*1 and stringer 12*h*2 can form a single stringer, which span the entire longitudinal direction of mast 12. Generally, in implementations mast 12 can include shear webs (otherwise known as spars), which can extend from side portion 12*e* to side portion 12*f*, and which can span the entire mast 12, but in other implementations shear webs can be excluded from use with mast 12.

In implementations, board end 12*a* of mast 12 is shown to include opening 12*a*1. In implementations, fuselage end 12*c* of mast 12 is shown to include opening 12*c*1. In implementations, side portion 12*f* of mast 12 is shown to include receptor portion 12*f*1, and receptor portion 12*f*2. In implementations, mast 12 is shown to include stringer 12*h*2.

Figure 6:
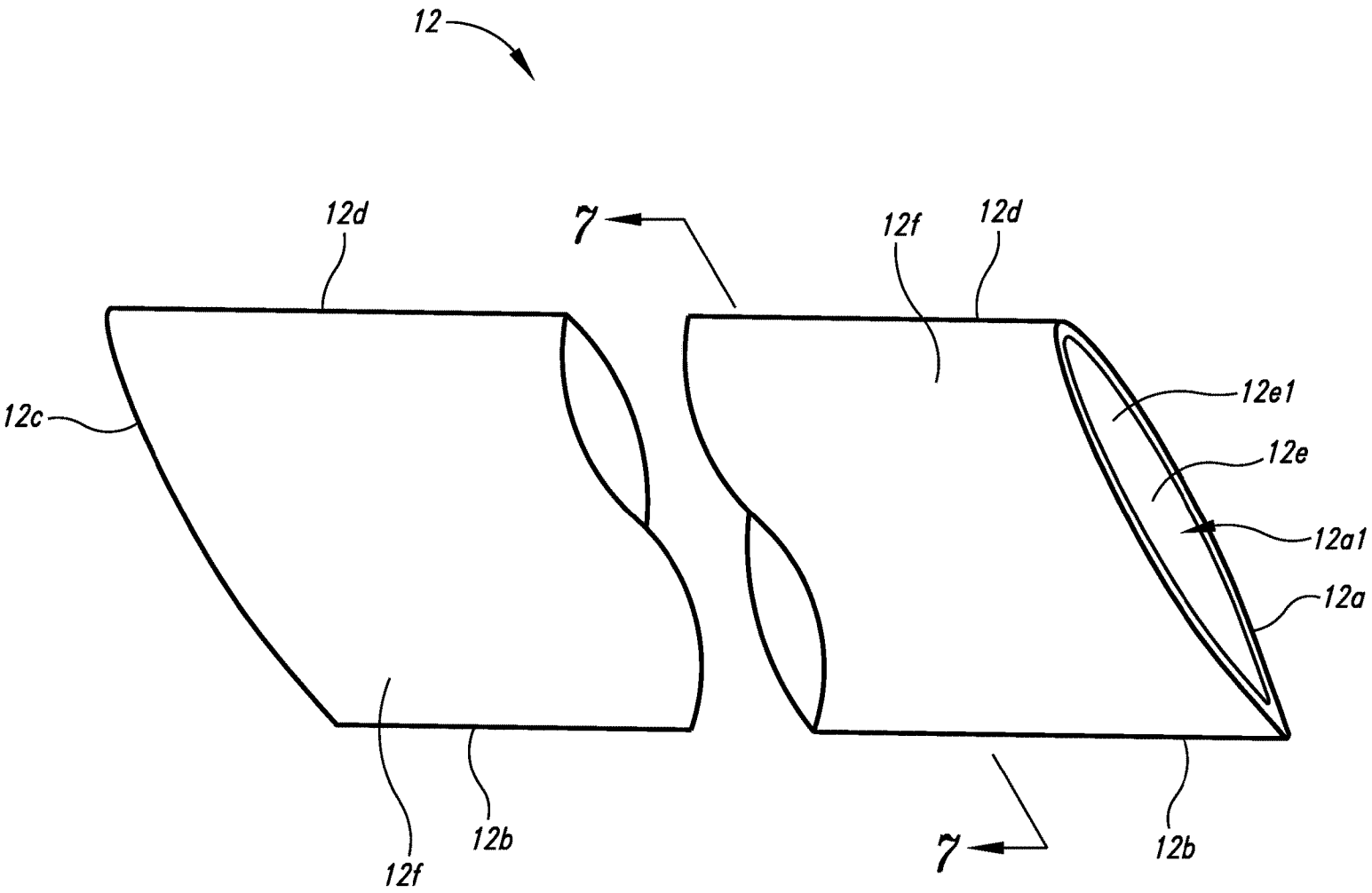
FIG. 6 is a top perspective view of the mast of FIG. 3.

Turning to FIG. 6, depicted therein is a top perspective view of mast 12. In implementations, side portion 12*e* of mast 12 is shown to include reception portion 12*e*1.

Figure 7:
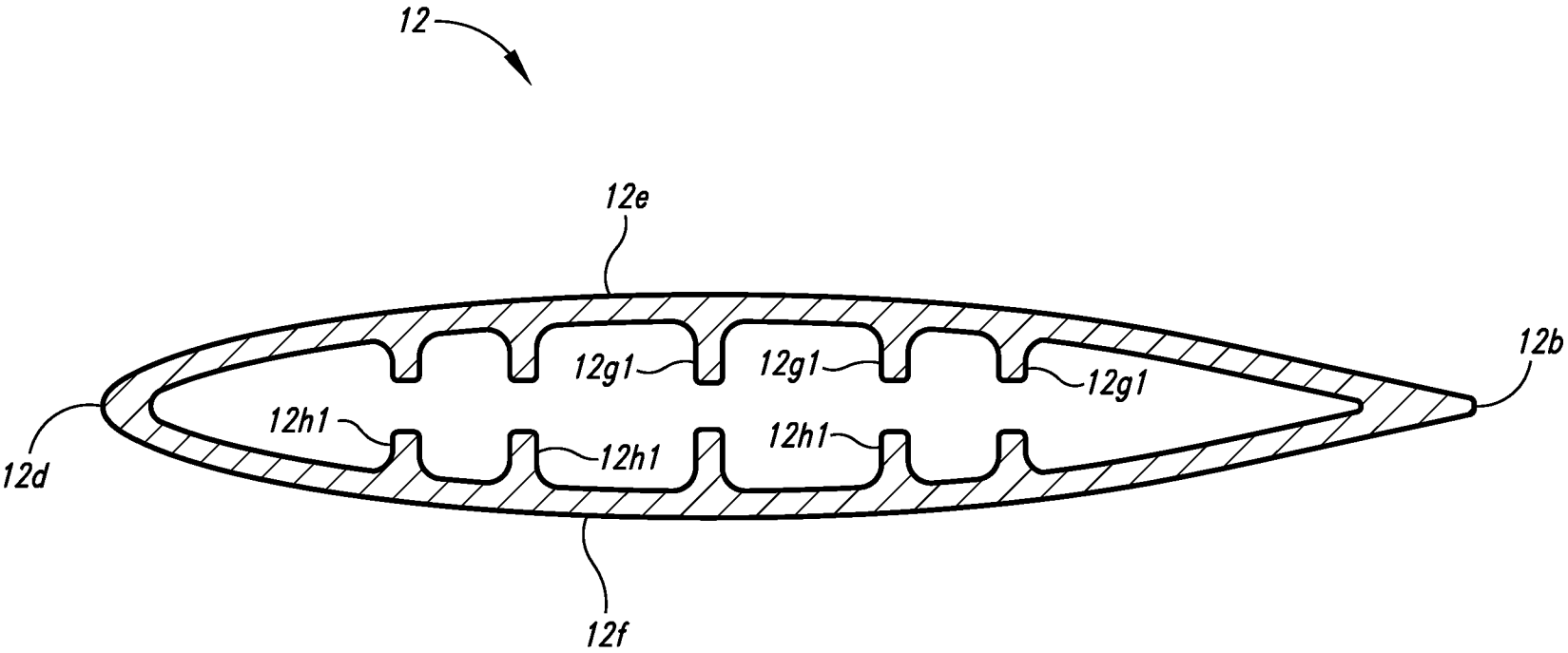
FIG. 7 is a cross-sectional top plan view of the mast of FIG. 3 taken along the 7-7 cut line of FIG. 6.

Turning to FIG. 7, depicted therein is a cross-sectional top plan view of mast 12 taken along the 7-7 cut line of FIG. 6.

Figure 8:
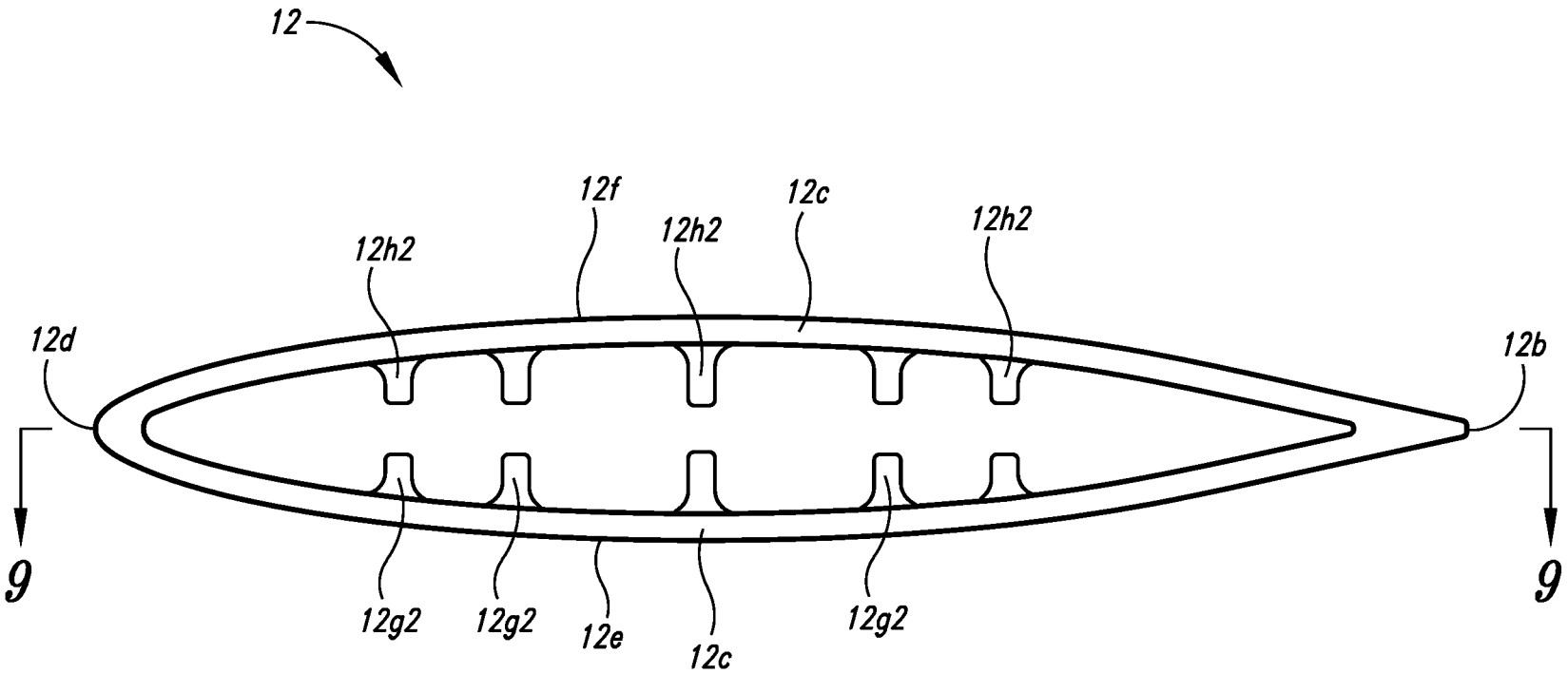
FIG. 8 is a bottom plan view of a mast of FIG. 3.

Turning to FIG. 8, depicted therein is a bottom plan view of mast 12. In implementations, mast 12 is shown to include stringer 12*g*2.

Figure 9:
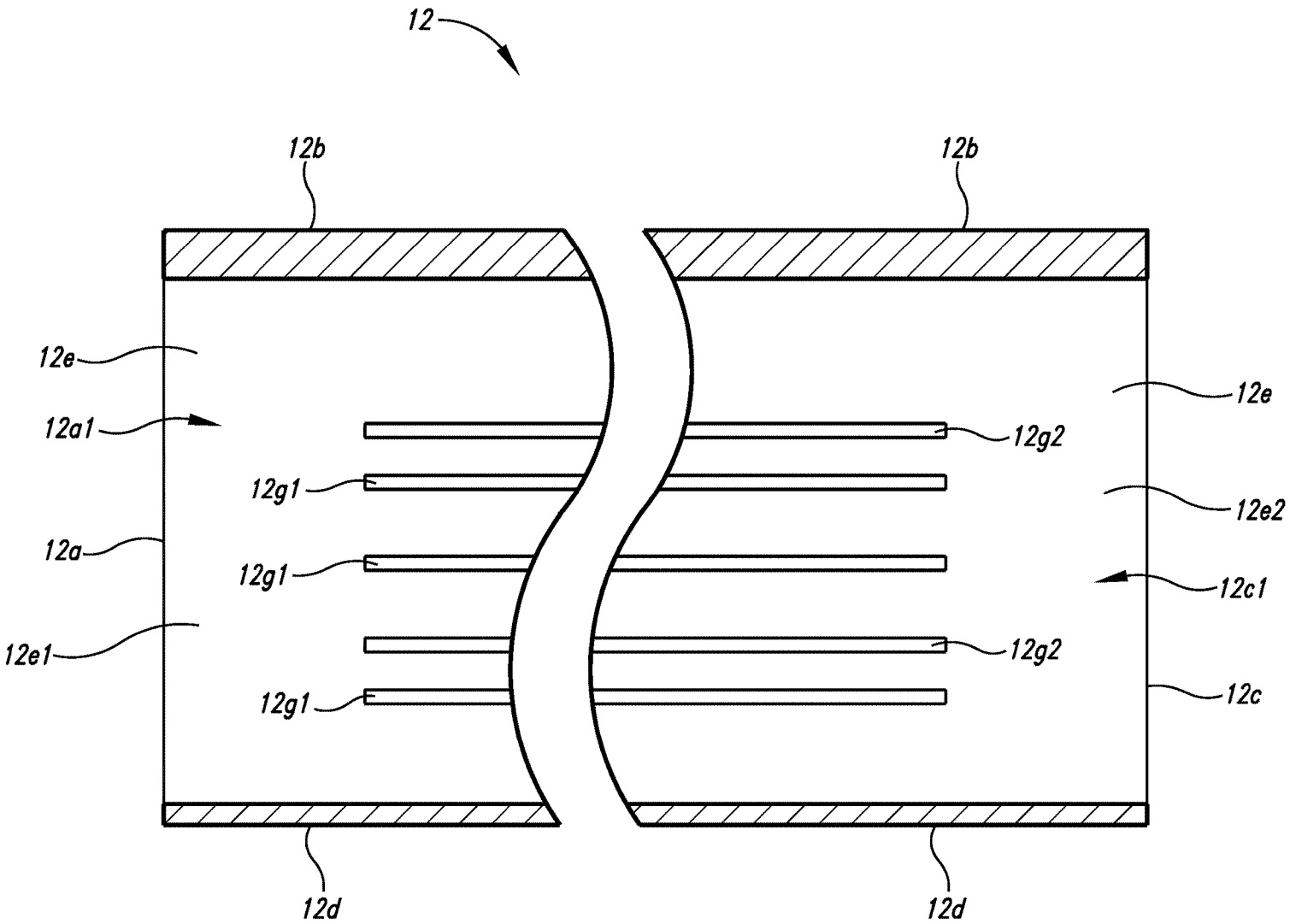
FIG. 9 is a cross-sectional elevational view of the mast of FIG. 3 taken along the 9-9 cut line of FIG. 8.

Turning to FIG. 9, depicted therein is a cross-sectional elevational view of mast 12 taken along the 9-9 cut line of FIG. 8. In implementations, side portion 12*e* of mast 12 is shown to include reception portion 12*e*2.

Figure 10:
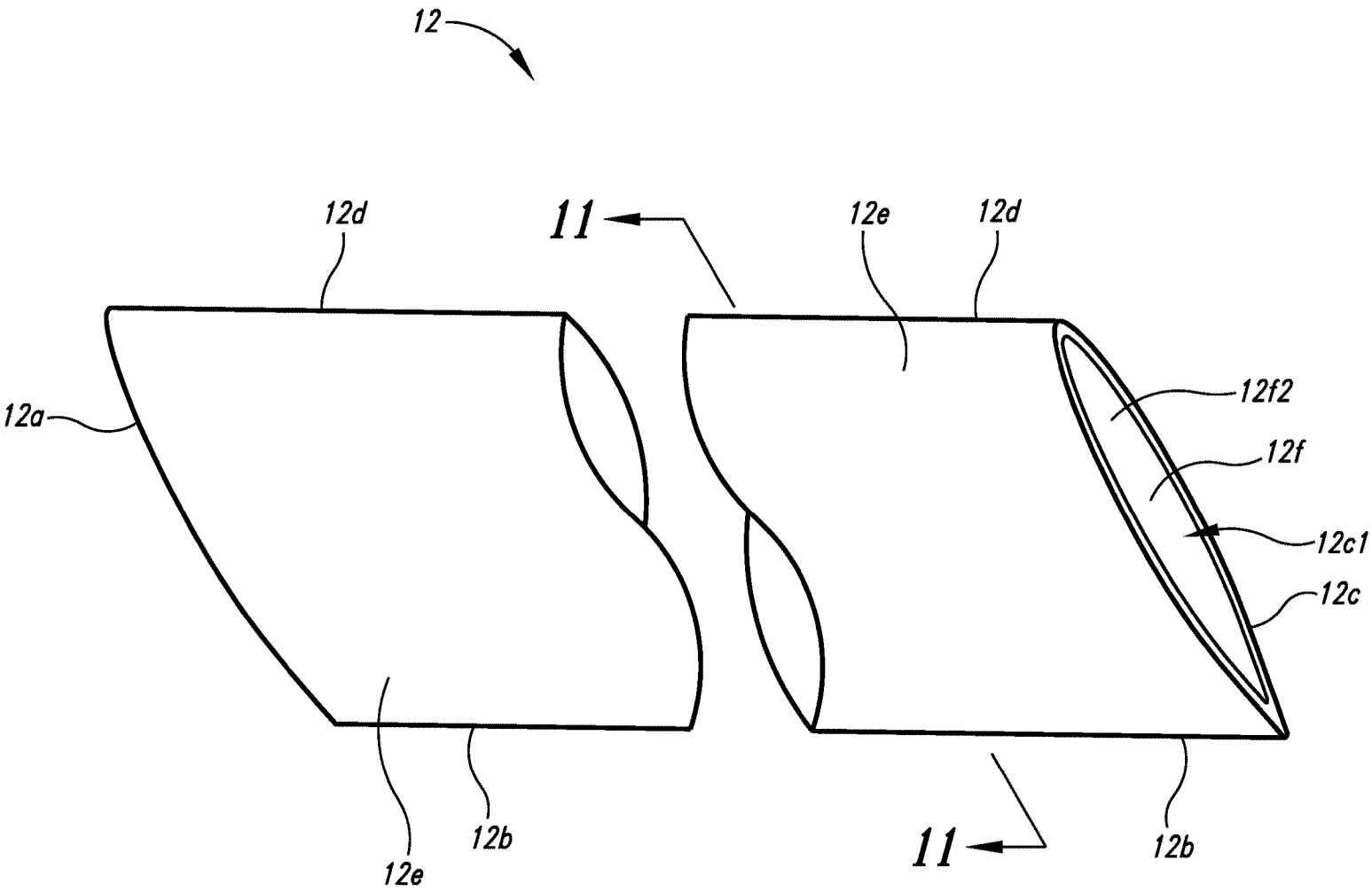
FIG. 10 is a bottom perspective view of the mast of FIG. 3.

Turning to FIG. 10, depicted therein is a bottom perspective view of mast 12.

Figure 11:
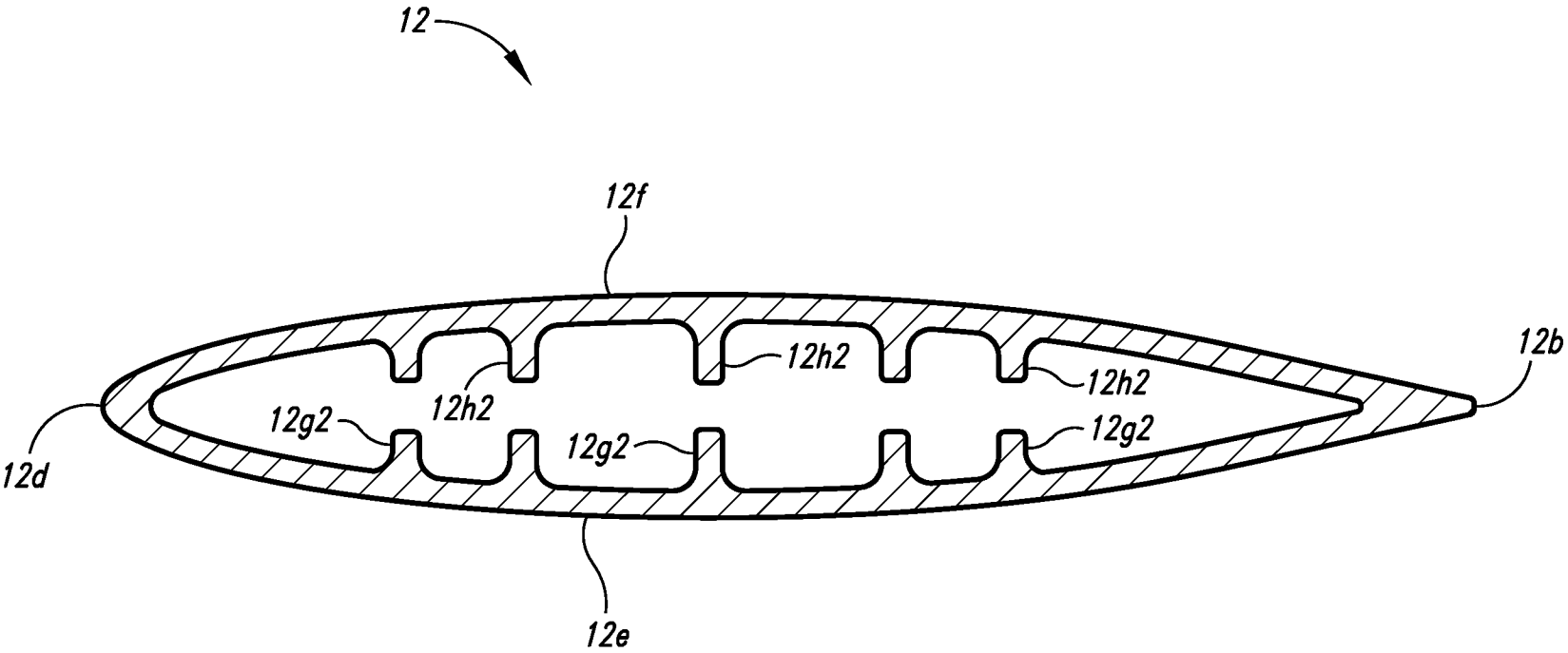
FIG. 11 is a cross-sectional bottom plan view of the mast of FIG. 3 taken along the 11-11 cut line of FIG. 10.

Turning to FIG. 11, depicted therein is a cross-sectional bottom plan view of mast 12 taken along the 11-11 cut line of FIG. 10.

Figure 12:
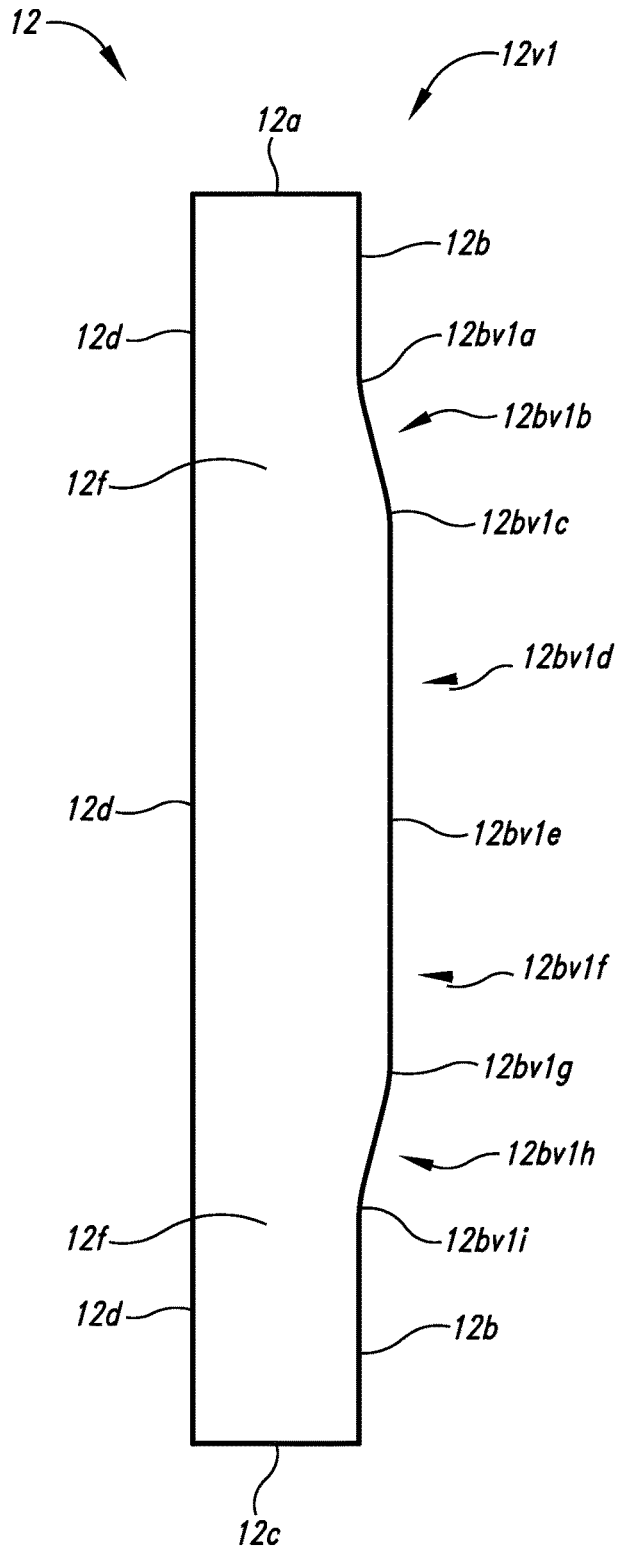
FIG. 12 is a side elevational view of a first implementation of the mast of FIG. 3.

Turning to FIG. 12, depicted therein is a side elevational view of a first implementation of mast 12. In implementations, mast 12*v*1 is shown to include position 12*bv*1*a*, transition portion 12*bv*1*b*, position 12*bv*1*c*, transition portion 12*bv*1*d*, mid position 12*bv*1*e*, transition portion 12*bv*1*f*, position 12*bv*1*g*, transition portion 12*bv*1*h*, and position 12*bv*1*i*.

Figure 13:
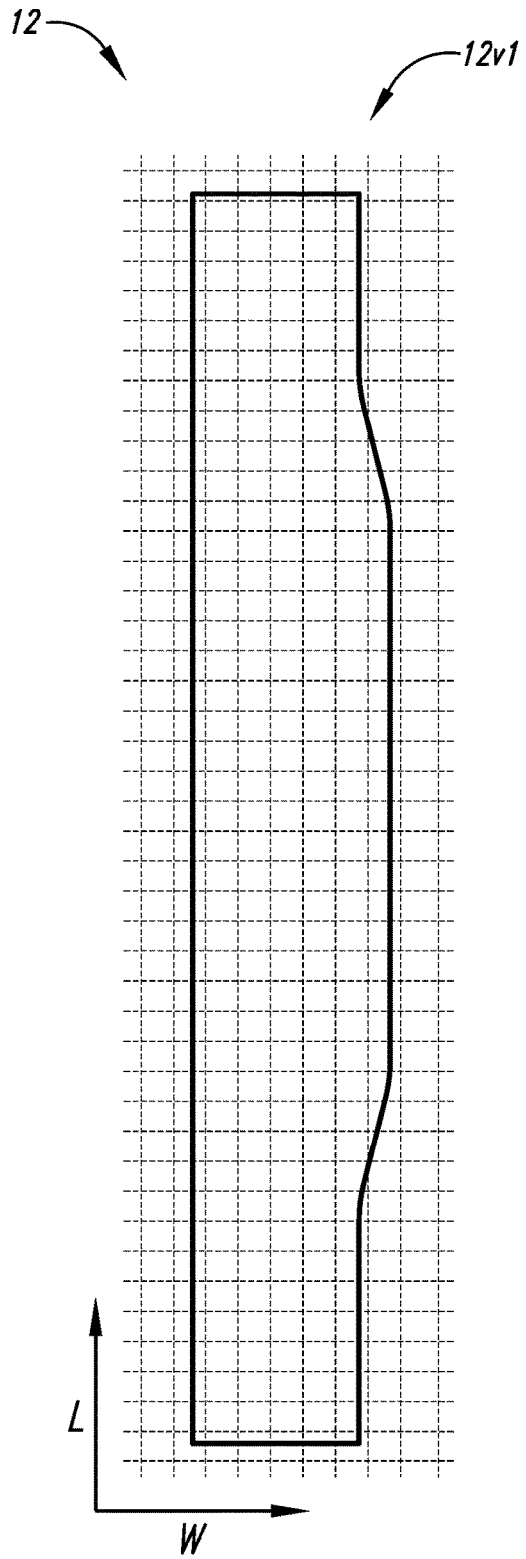
FIG. 13 is a side elevational view of the first implementation of the mast of FIG. 3.

Turning to FIG. 13, depicted therein is a side elevational view of the first implementation of mast 12. In implementations, mast 12*v*1 is shown to include length dimension L of mast 12, and width dimension W of mast 12. In implementations length dimension L of mast 12 can be greater than 49 cm and less than 151 cm. In implementations width dimension W of mast 12, also known as chord length, can be greater than 89 mm and less than 151 mm. In implementations maximum of width dimension W can be greater than at least 5% of minimum of width dimension W. In implementations maximum of width dimension W can be no greater than 75% of minimum of width dimension W. In implementations maximum dimension of width dimension W of mast 12 can occur along the middle 50% of length dimension L of mast 12. In implementations, minimum of thickness dimension T of mast 12 can occur at or near middle of length dimension L of mast 12, and/or at or near maximum width dimension W of mast 12. In implementations minimum of thickness dimension T can occur at least 15% of length dimension L from board end 12*a* or fuselage end 12*c*.

Figure 14:
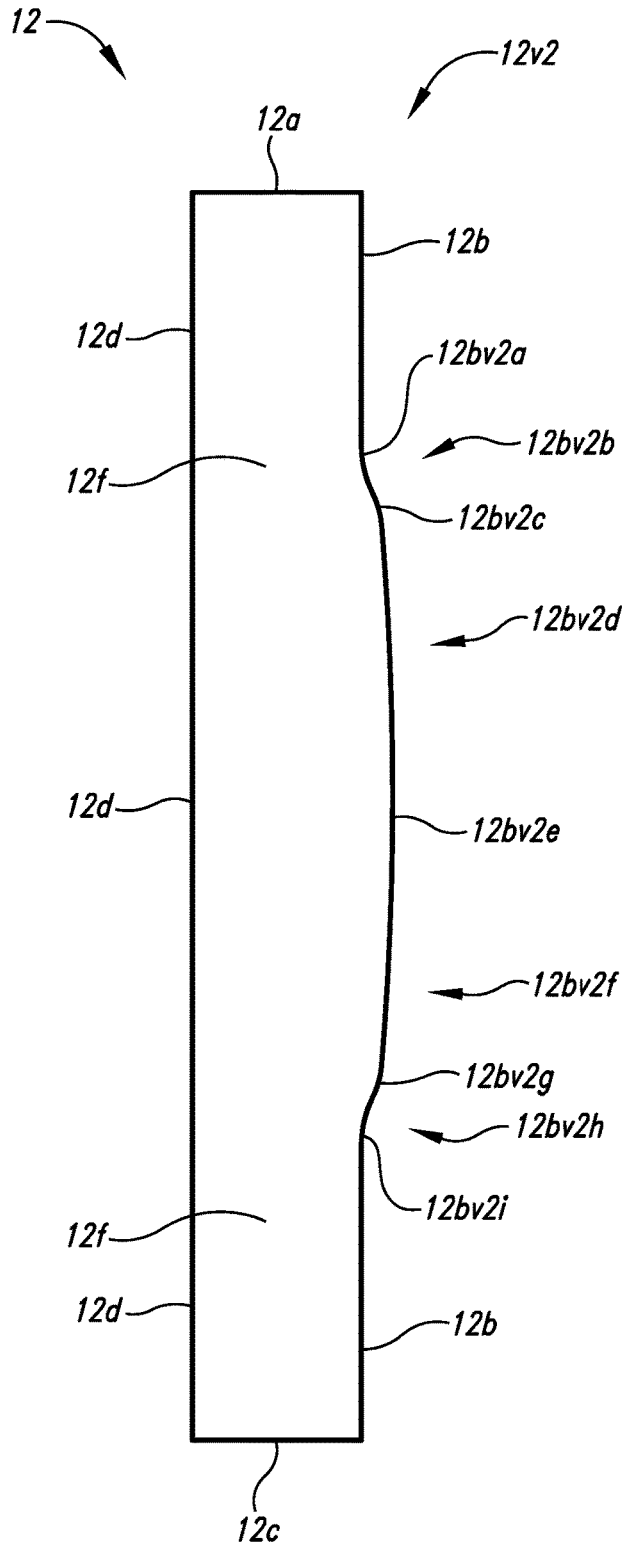
FIG. 14 is a side elevational view of a second implementation of the mast of FIG. 3.

Turning to FIG. 14, depicted therein is a side elevational view of a second implementation of mast 12. In implementations, mast 12*v*2 is shown to include position 12*bv*2*a*, transition portion 12*bv*2*b*, position 12*bv*2*c*, transition portion 12*bv*2*d*, mid position 12*bv*2*e*, transition portion 12*bv*2*f*, position 12*bv*2*g*, transition portion 12*bv*2*h*, and position 12*bv*2*i*.

Figure 15:
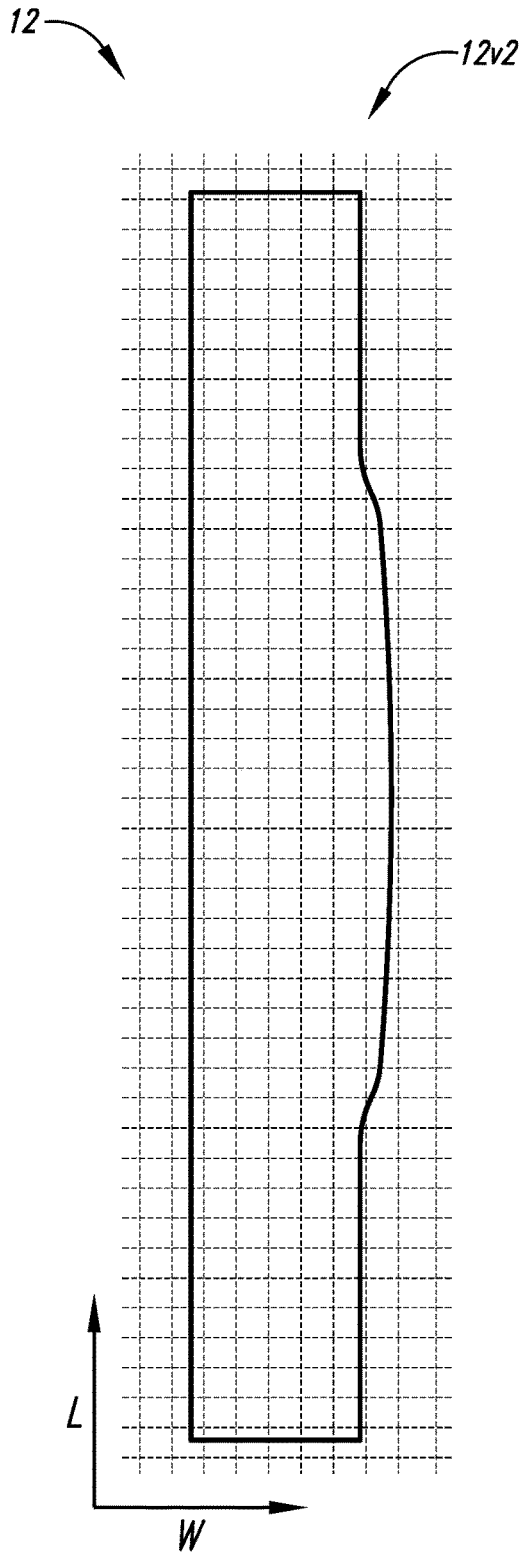
FIG. 15 is a side elevational view of the second implementation of the mast of FIG. 3.

Turning to FIG. 15, depicted therein is a side elevational view of the second implementation of mast 12.

Figure 16:
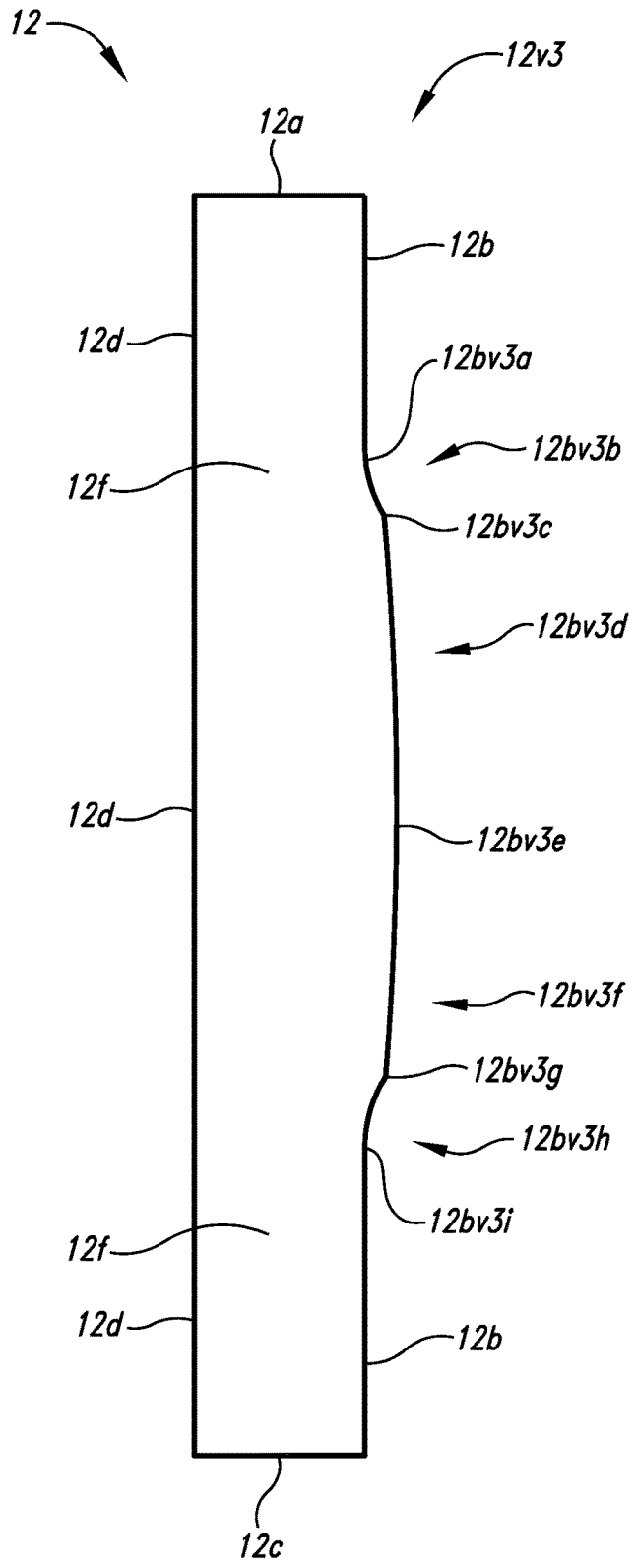
FIG. 16 is a side elevational view of a third implementation of the mast of FIG. 3.

Turning to FIG. 16, depicted therein is a side elevational view of a third implementation of mast 12. In implementations, mast 12*v*3 is shown to include position 12*bv*3*a*, transition portion 12*bv*3*b*, position 12*bv*3*c*, transition portion 12*bv*3*d*, mid position 12*bv*3*e*, transition portion 12*bv*3*f*, position 12*bv*3*g*, transition portion 12*bv*3*h*, and position 12*bv*3*i*.

Figure 17:
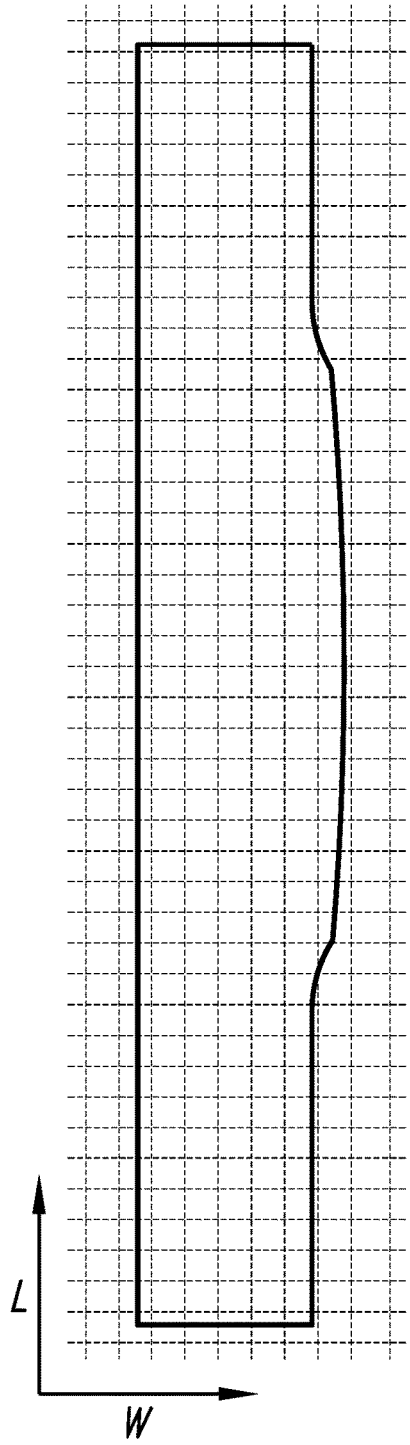
FIG. 17 is a side elevational view of the third implementation of the mast of FIG. 3.

Turning to FIG. 17, depicted therein is a side elevational view of the third implementation of mast 12.

Figure 18:
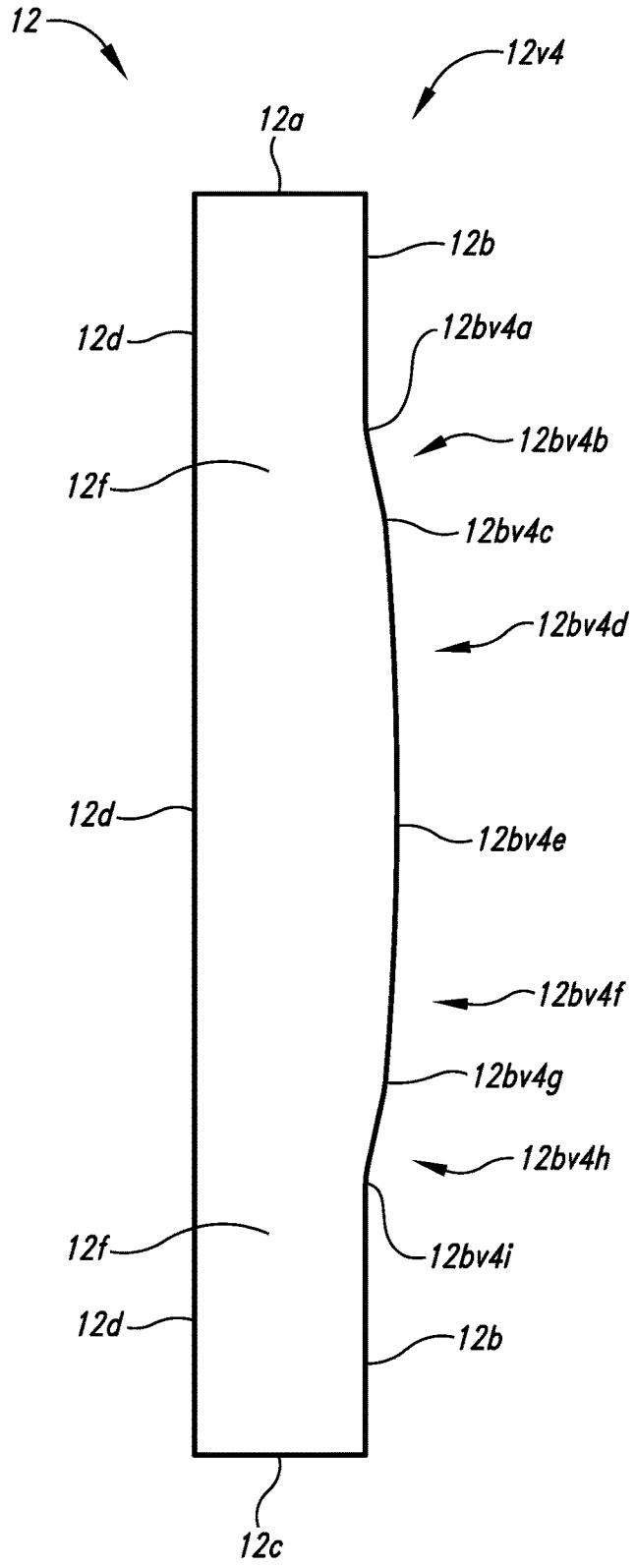
FIG. 18 is a side elevational view of a fourth implementation of the mast of FIG. 3.

Turning to FIG. 18, depicted therein is a side elevational view of a fourth implementation of mast 12. In implementations, mast 12*v*4 is shown to include position 12*bv*4*a*, transition portion 12*bv*4*b*, position 12*bv*4*c*, transition portion 12*bv*4*d*, mid position 12*bv*4*e*, transition portion 12*bv*4*f*, position 12*bv*4*g*, transition portion 12*bv*4*h*, and position 12*bv*4*i*.

Figure 19:
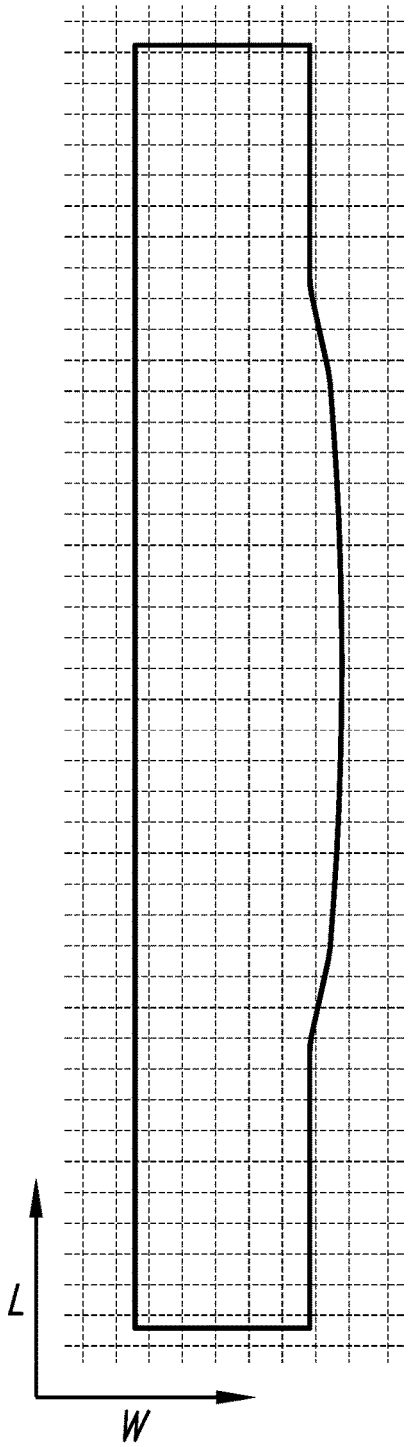
FIG. 19 is a side elevational view of the fourth implementation of the mast of FIG. 3.

Turning to FIG. 19, depicted therein is a side elevational view of the fourth implementation of mast 12.

Figure 20:
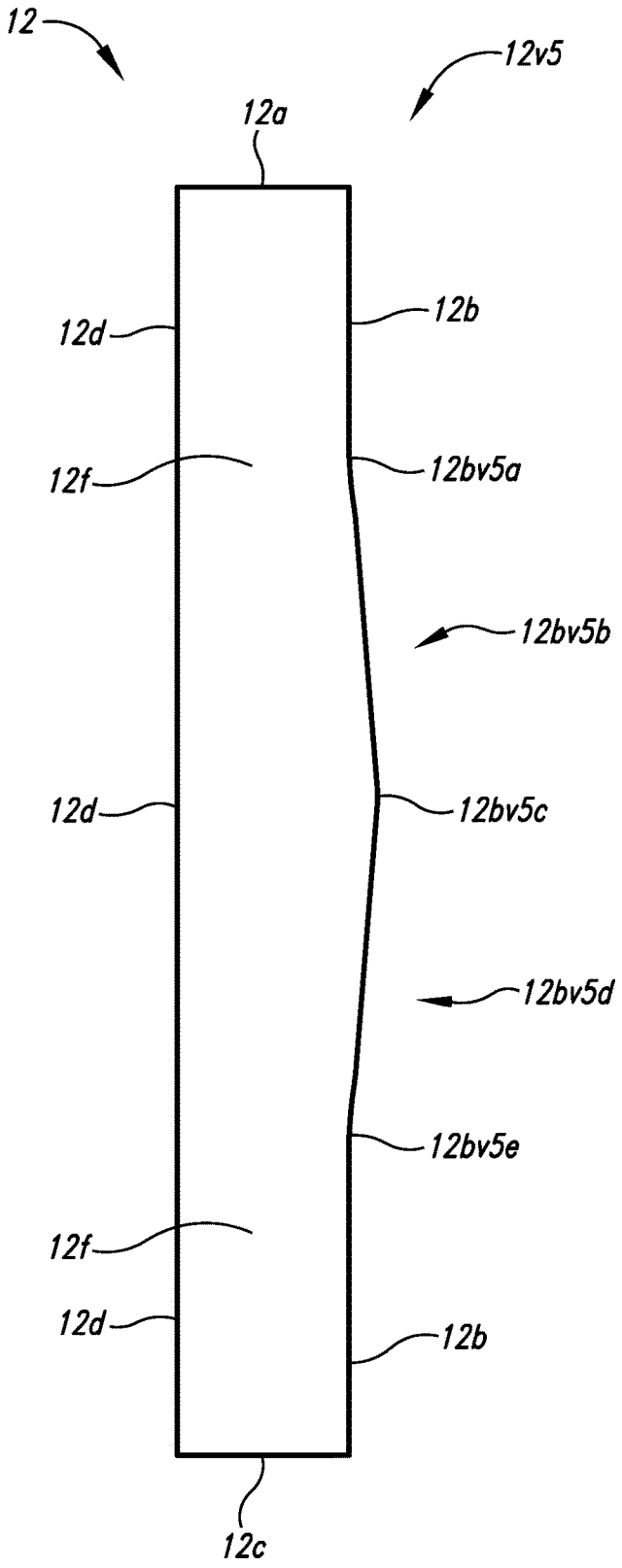
FIG. 20 is a side elevational view of a fifth implementation of the mast of FIG. 3.

Turning to FIG. 20, depicted therein is a side elevational view of a fifth implementation of mast 12. In implementations, mast 12*v*5 is shown to include position 12*bv*5*a*, transition portion 12*bv*5*b*, mid position 12*bv*5*c*, transition portion 12*bv*5*d*, and position 12*bv*5*e*.

Figure 21:
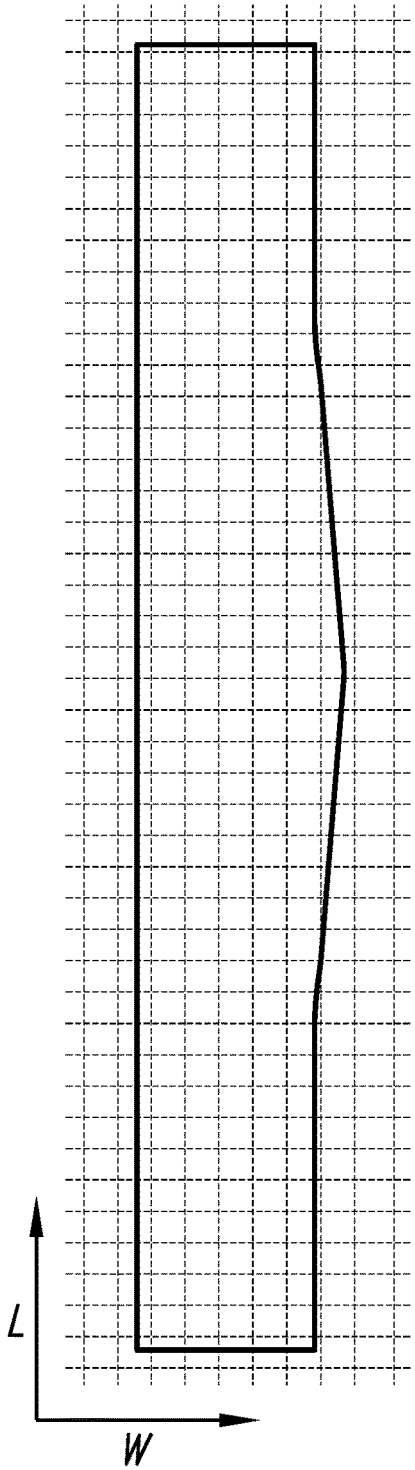
FIG. 21 is a side elevational view of the fifth implementation of the mast of FIG. 3.

Turning to FIG. 21, depicted therein is a side elevational view of the fifth implementation of mast 12.

Figure 22:
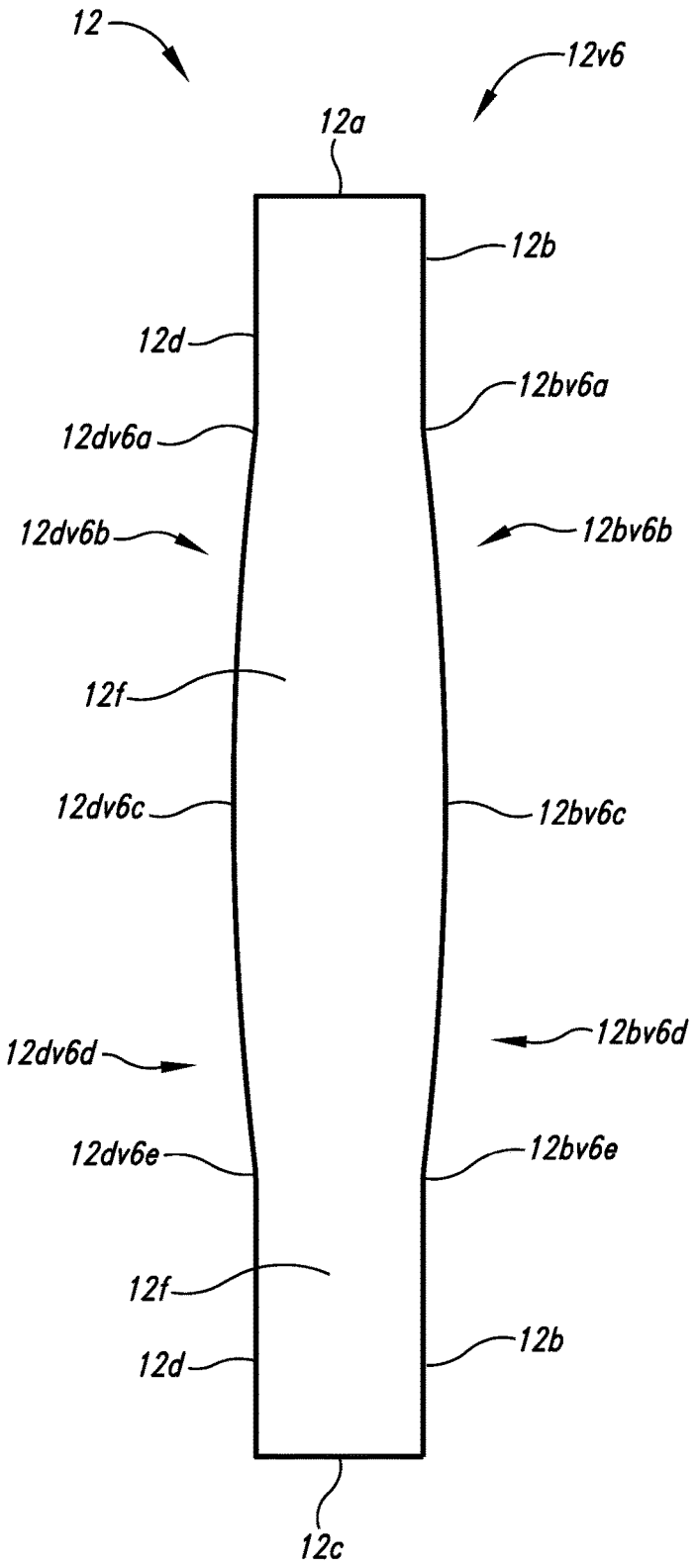
FIG. 22 is a side elevational view of a sixth implementation of the mast of FIG. 3.

Turning to FIG. 22, depicted therein is a side elevational view of a sixth implementation of mast 12. In implementations, mast 12*v*6 is shown to include position 12*bv*6*a*, transition portion 12*bv*6*b*, mid position 12*bv*6*c*, transition portion 12*bv*6*d*, and position 12*bv*6*e*.

Figure 23:
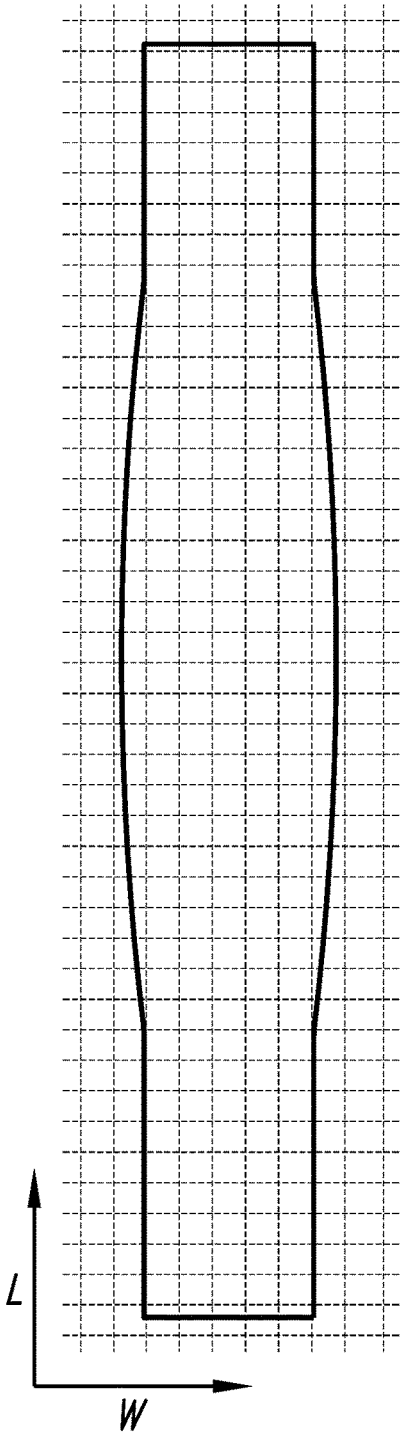
FIG. 23 is a side elevational view of the sixth implementation of the mast of FIG. 3.

Turning to FIG. 23, depicted therein is a side elevational view of the sixth implementation of mast 12.

Figure 24:
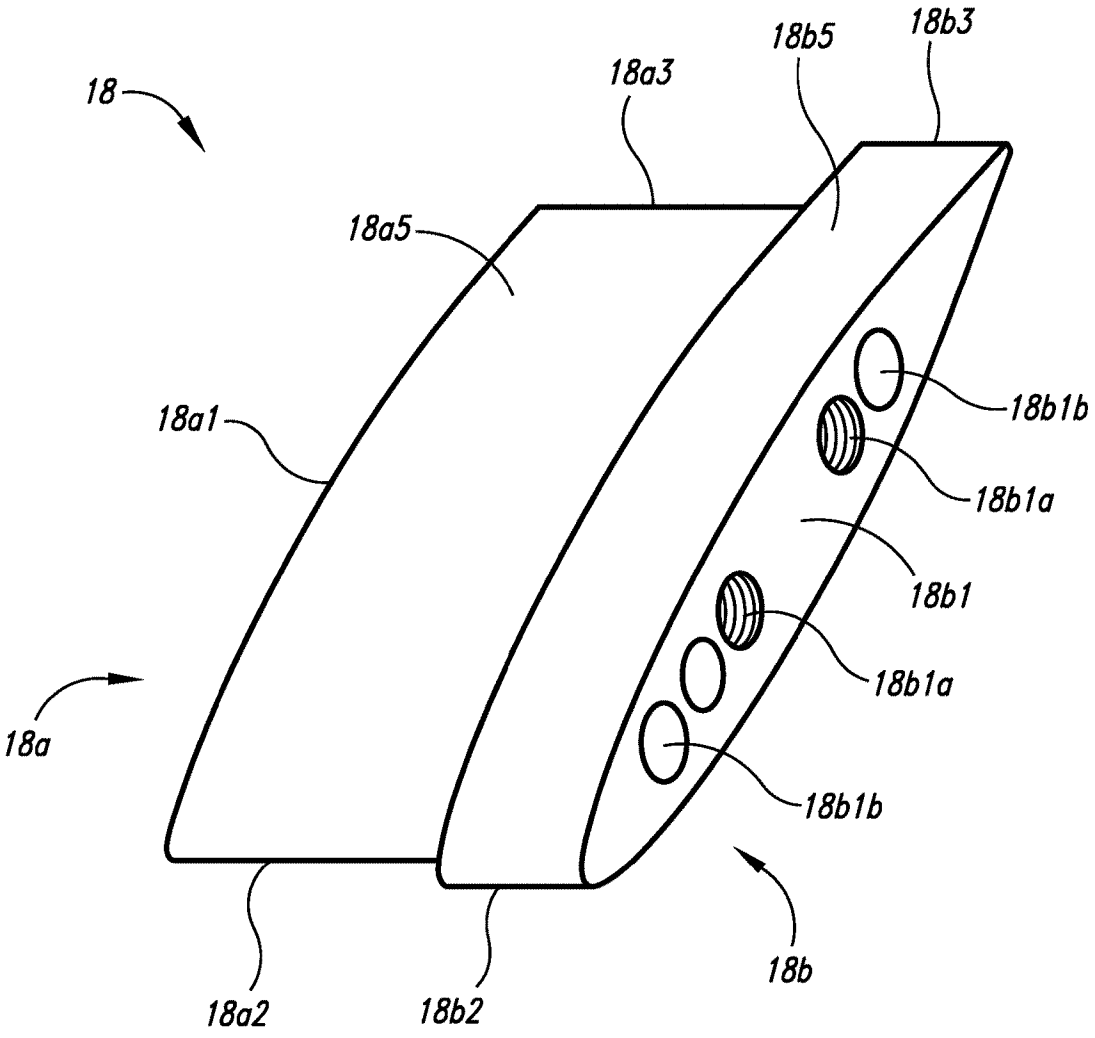
FIG. 24 is a front perspective view of a fuselage adapter insert of the mast assembly of FIG. 3.

Turning to FIG. 24, depicted therein is a front perspective view of fuselage adapter insert 18 of mast assembly 10. In implementations, fuselage side 18*b*1 of flange portion 18*b* of fuselage adapter insert 18 is shown to include non-threaded dowel pin hole 18*b*1*a* and threaded fastener hole 18*b*1*b*. In implementations, insert portion 18*a* of fuselage adapter insert 18 is shown to include side portion 18*a*5. In implementations, flange portion 18*b* of fuselage adapter insert 18 is shown to include side portion 18*b*5. Implementations non-threaded holes or threaded holes can also be part of board end 12*a* or fuselage end 12*c* extending into side portion 12*e* or side portion 12*f* of mast 12 along length dimension L a minimum distance such as 25 mm.

Figure 25:
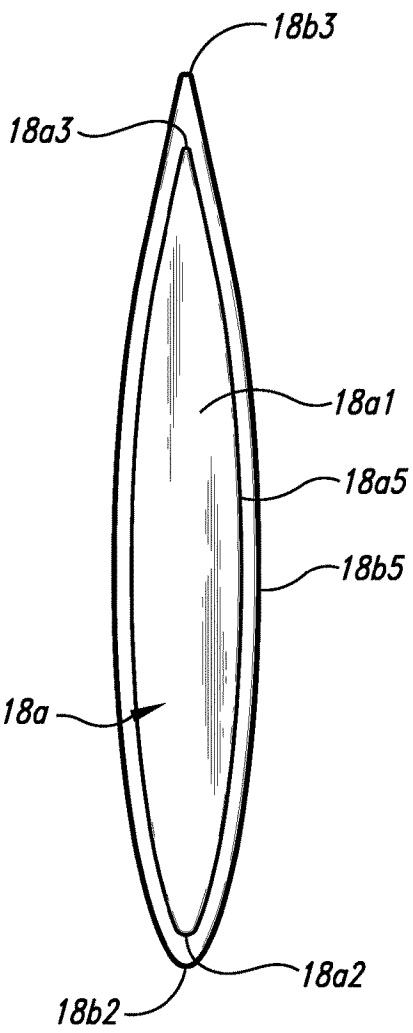
FIG. 25 is an end plan view of the fuselage adapter insert of FIG. 24 of the mast assembly of FIG. 3.

Turning to FIG. 25, depicted therein is an end plan view of fuselage adapter insert 18 of mast assembly 10.

Figure 26:
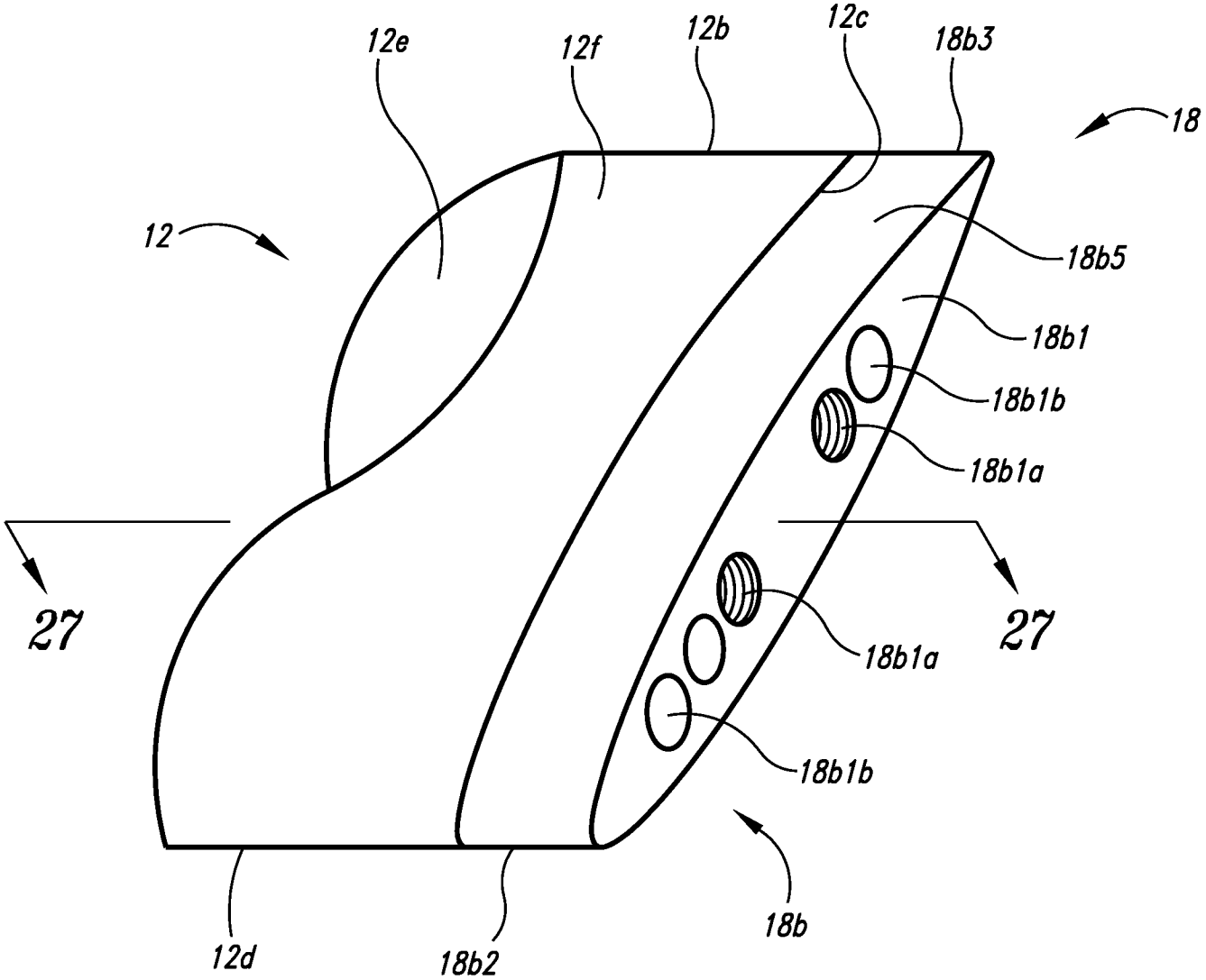
FIG. 26 is a front perspective view of the fuselage adapter insert of FIG. 24 coupled with the mast of the mast assembly of FIG. 3.

Turning to FIG. 26, depicted therein is a front perspective view of fuselage adapter insert 18 coupled with mast 12 of mast assembly 10.

Figure 27:
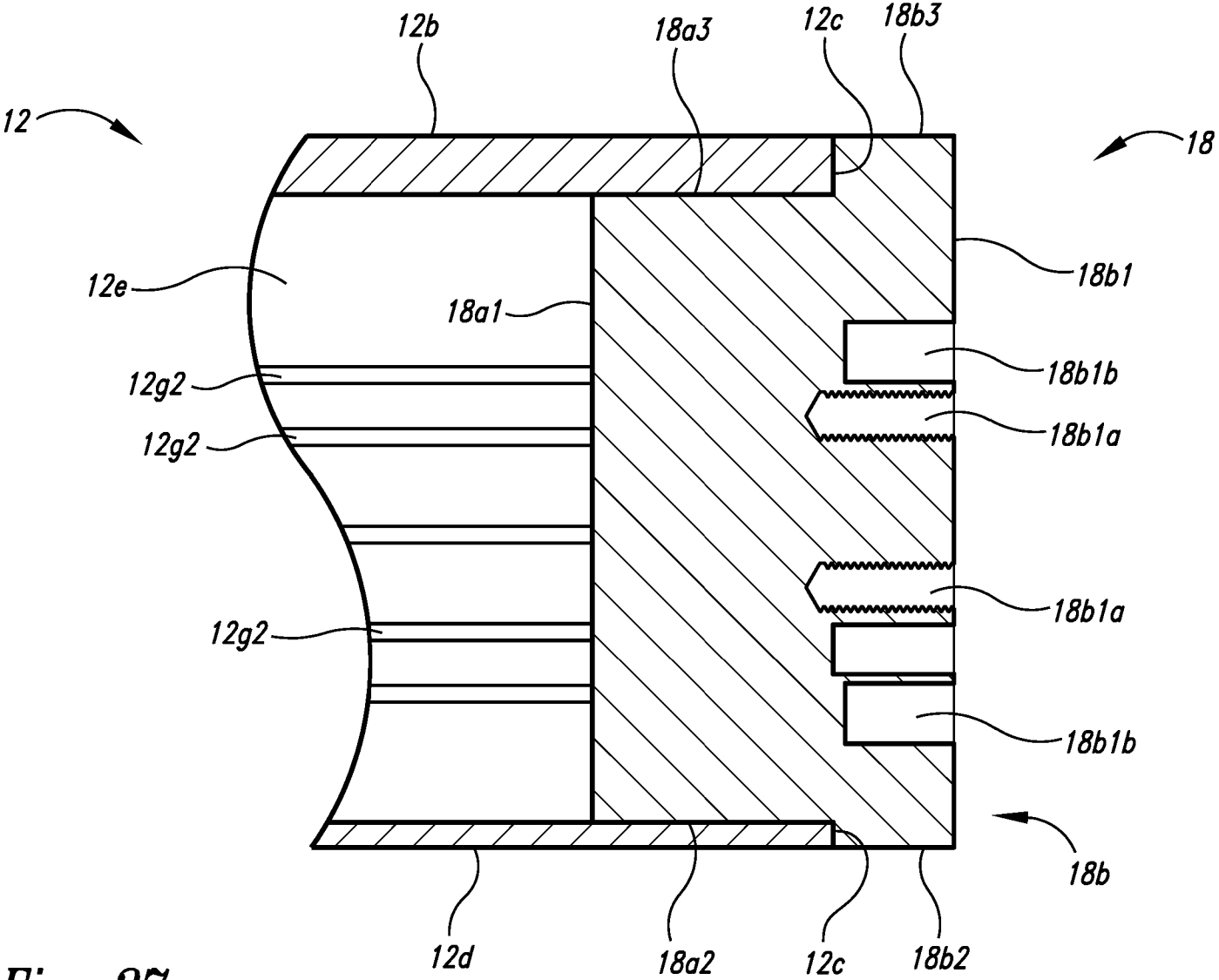
FIG. 27 is a side elevational cross-sectional view of the fuselage adapter insert of FIG. 24 coupled with the mast of the mast assembly of FIG. 3 taken along the 27-27 cut line of FIG. 26.

Turning to FIG. 27, depicted therein is a side elevational cross-sectional view of fuselage adapter insert 18 coupled with the mast 12 taken along the 27-27 cut line of FIG. 26.

In implementations fuselage adapter insert 18 as a machined aluminum insert can coupled with mast 12 by press-fitting into fuselage end 12*c* of mast 12. In implementations fuselage adapter insert 18 can be machined with tighter tolerances than mast 12. In implementations fuselage adapter insert 18 can be adhesively bonded with fuselage end 12*c* of mast 12.

Figure 28:
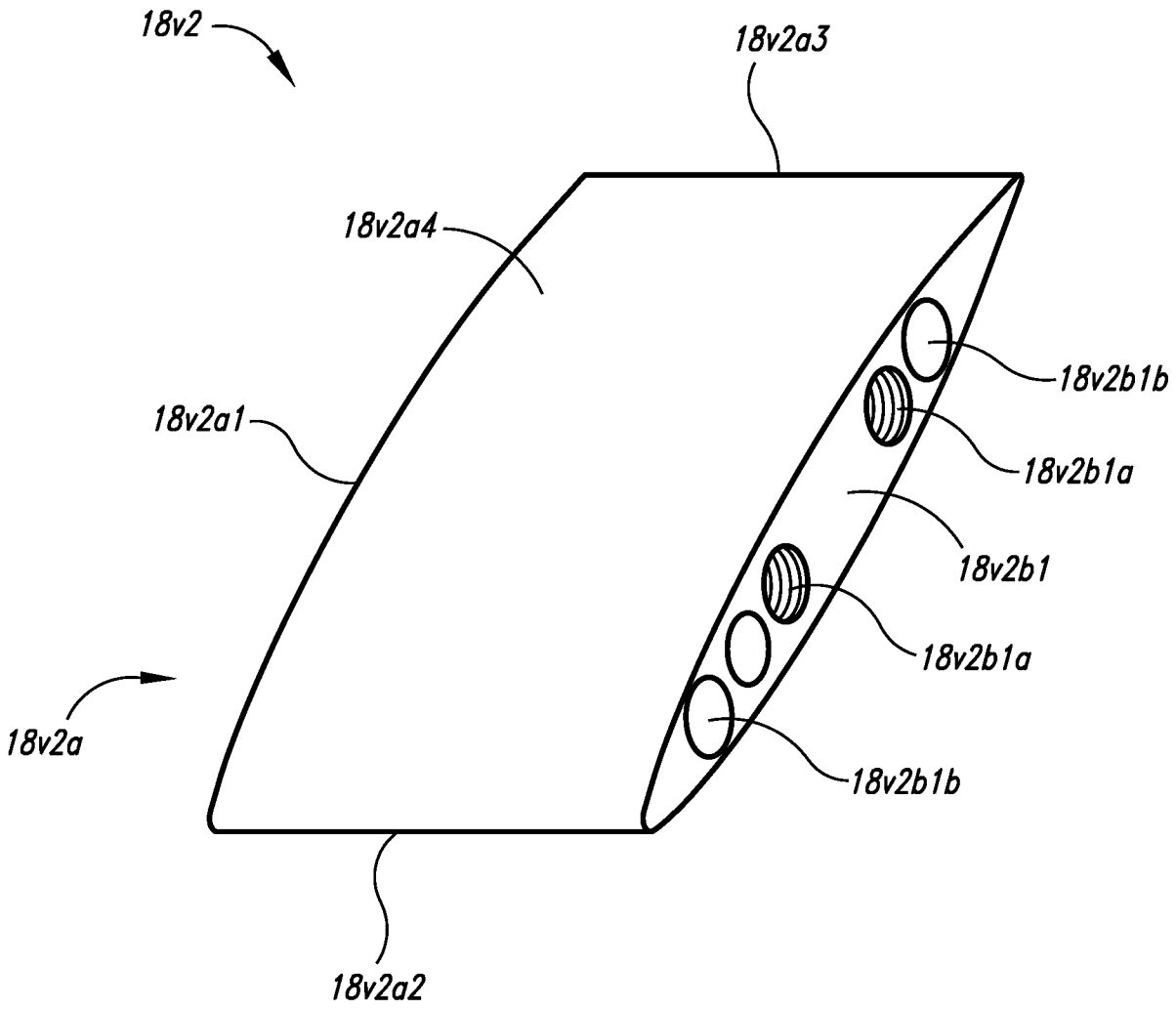
FIG. 28 is a front perspective view of a second implementation of a fuselage adapter insert.

Turning to FIG. 28, depicted therein is a front perspective view of adapter insert 18*v*2. In implementations, adapter insert 18*v*2 is shown to include insert portion 18*v*2*a*, and fastener portion 20*b*1. In implementations, insert portion 18*v*2*a* is shown to include mast side 18*v*2*a*1, leading side 18*v*2*a*2, trailing side 18*v*2*a*3, and side portion 18*v*2*a*4. In implementations, fuselage side 18*v*2*b*1 is shown to include non-threaded dowel pin hole 18*v*2*b*1*a*, and threaded fastener hole 18*v*2*b*1*b*.

Figure 29:
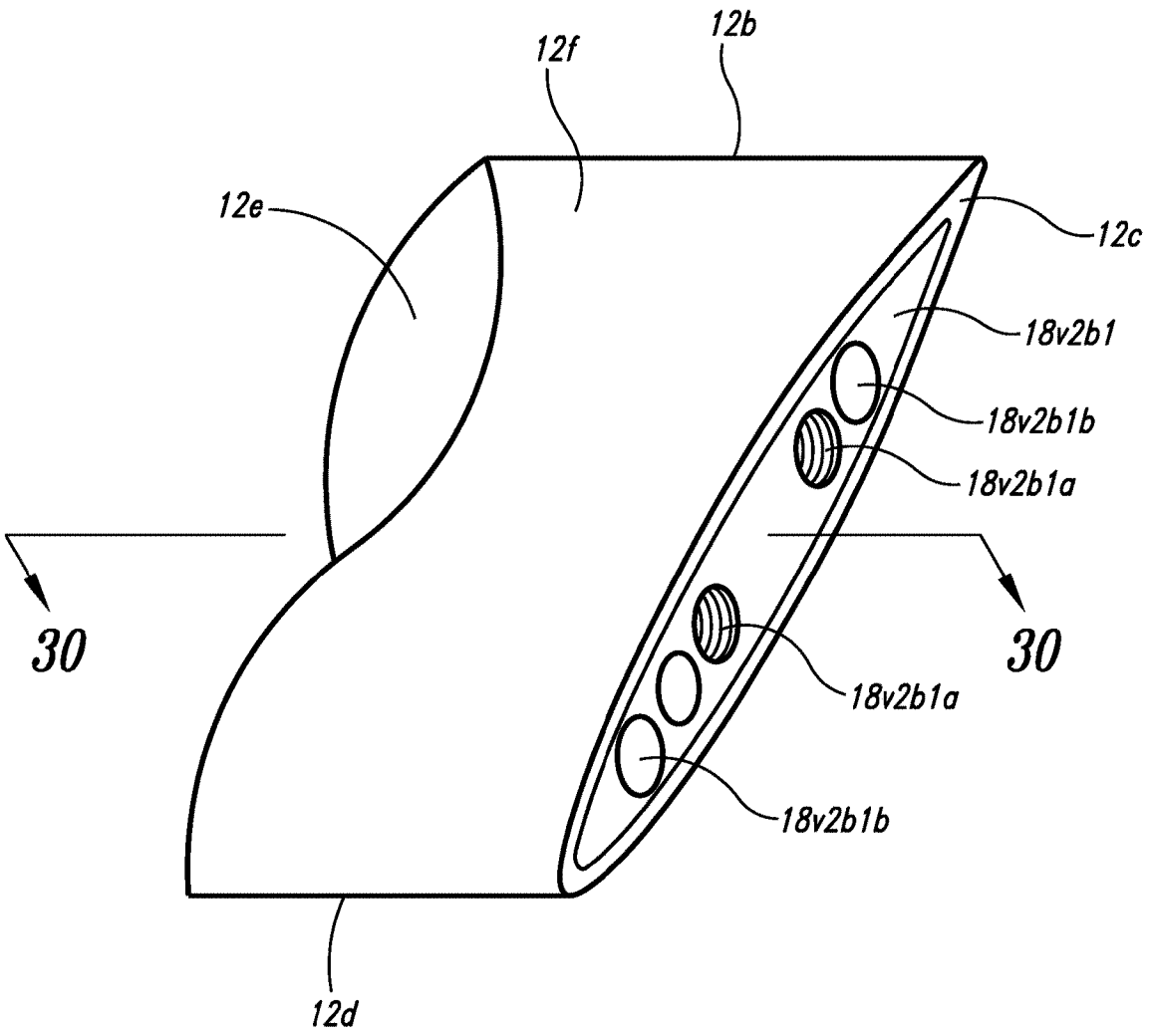
FIG. 29 is a front perspective view of the second implementation of the fuselage adapter insert of FIG. 28 coupled with the mast of the mast assembly of FIG. 3.

Turning to FIG. 29, depicted therein is a front perspective view of adapter insert 18*v*2 coupled with mast 12 of mast assembly 10.

Figure 30:
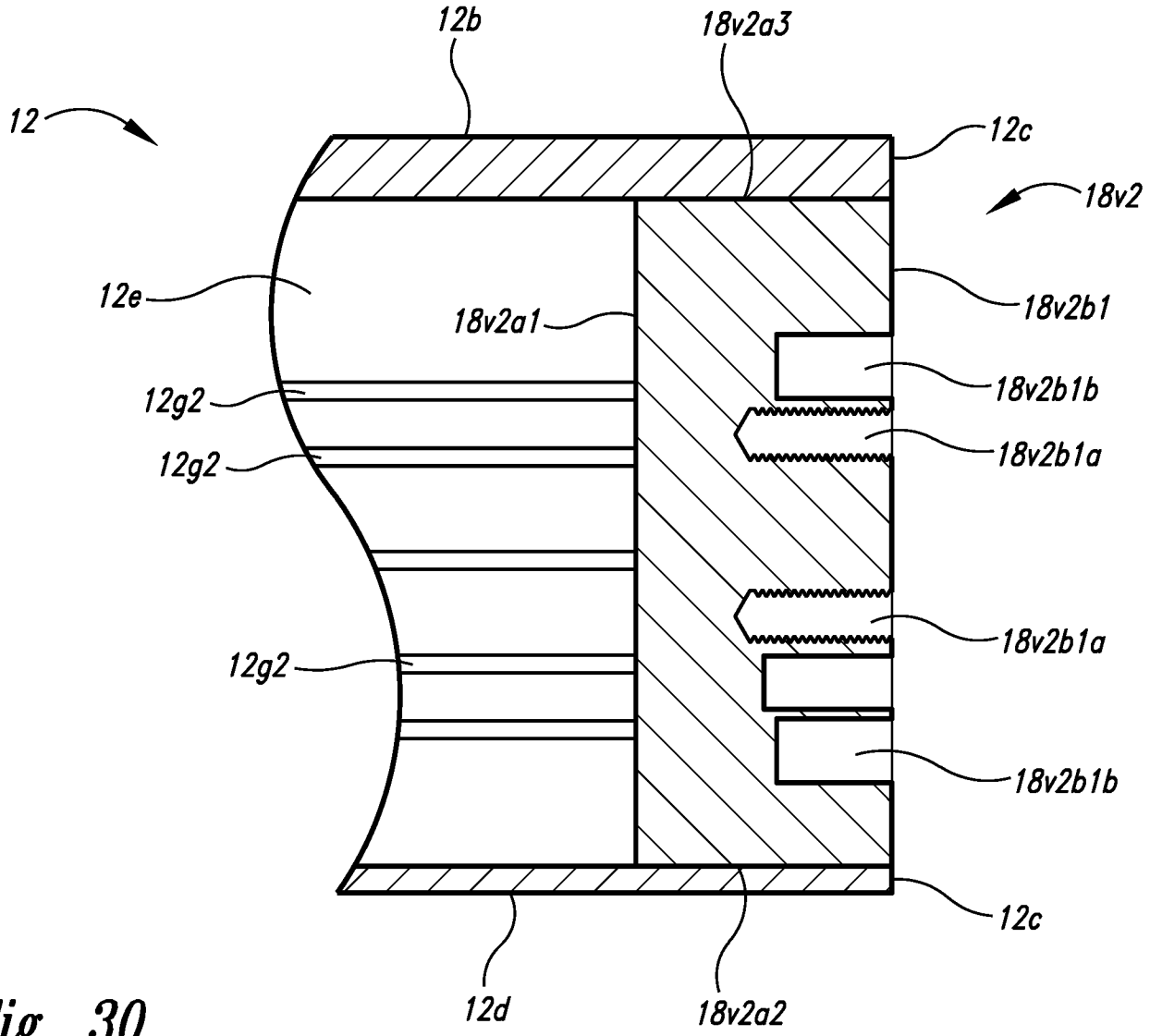
FIG. 30 is a side elevational cross-sectional view of the second implementation of the fuselage adapter insert of FIG. 28 coupled with the mast of the mast assembly of FIG. 3 taken along the 30-30 cut line of FIG. 29.

Turning to FIG. 30, depicted therein is a side elevational cross-sectional view of adapter insert 18*v*2 coupled with mast 12 taken along the 30-30 cut line of FIG. 29. Although adapter insert 18*v*2 is shown as planar with fuselage end 12*c* of mast 12, in implementations adapter insert 18*v*2 can also be shown as sub-flush with fuselage end 12*c* of mast 12.

Figure 31:
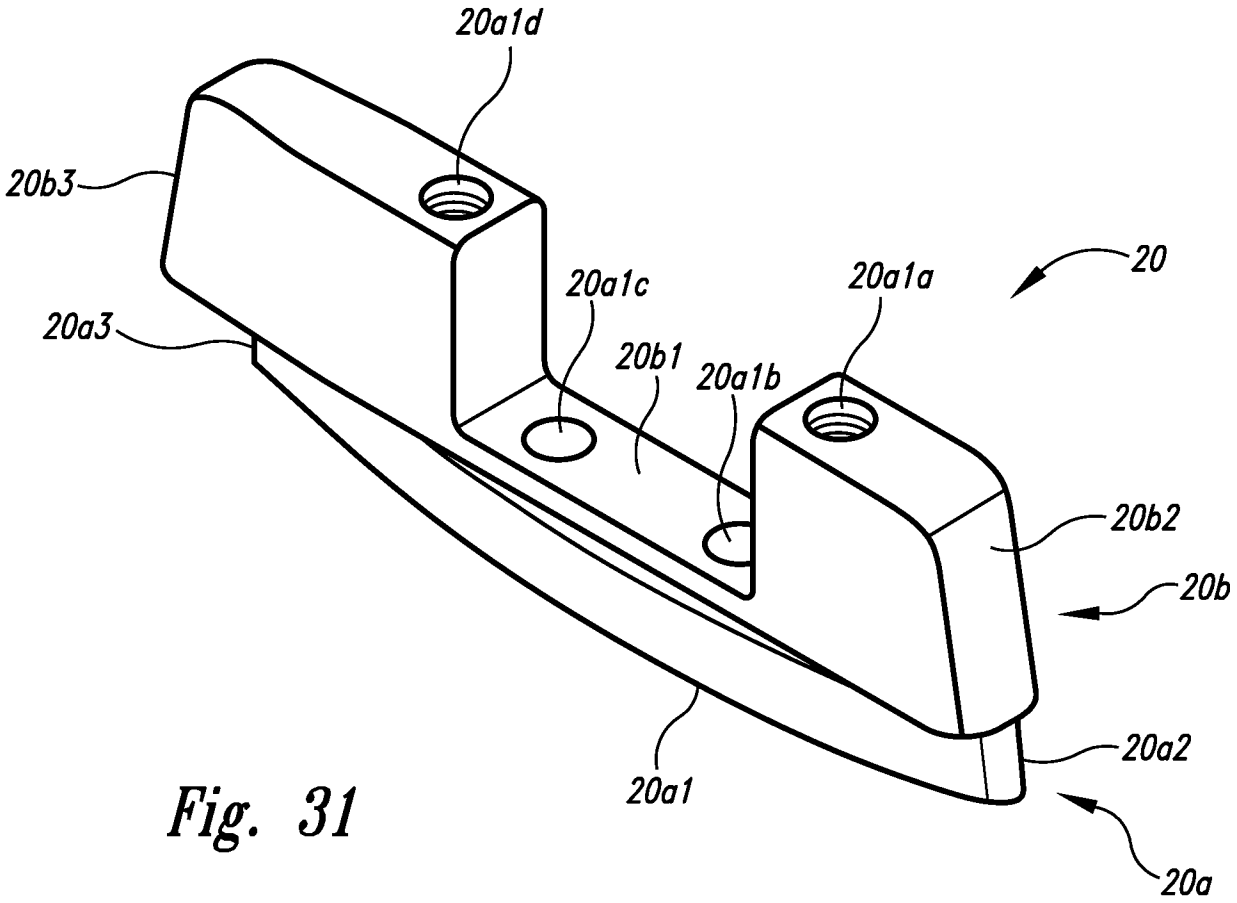
FIG. 31 is a front perspective view of the fuselage adapter of FIG. 3.

Turning to FIG. 31, depicted therein is a front perspective view of fuselage adapter 20. In implementations, mast side 20*a*1 of mast coupler portion 20*a* of fuselage adapter 20 is shown to include threaded fastener hole 20*a*1*a*, threaded fastener hole 20*a*1*b*, threaded fastener hole 20*a*1*c*, and threaded fastener hole 20*a*1*d*.

Figure 32:
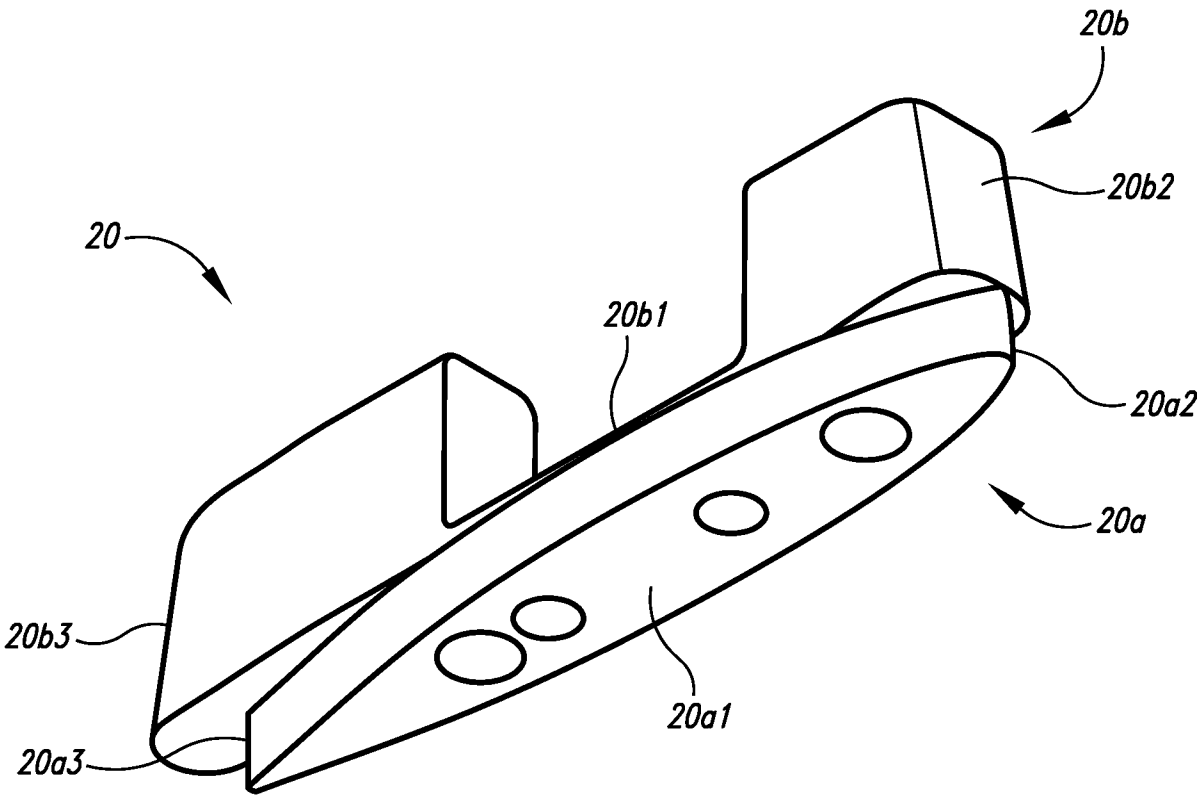
FIG. 32 is a front perspective view of the fuselage adapter of FIG. 3.

Turning to FIG. 32, depicted therein is a front perspective view of fuselage adapter 20.

Figure 33:
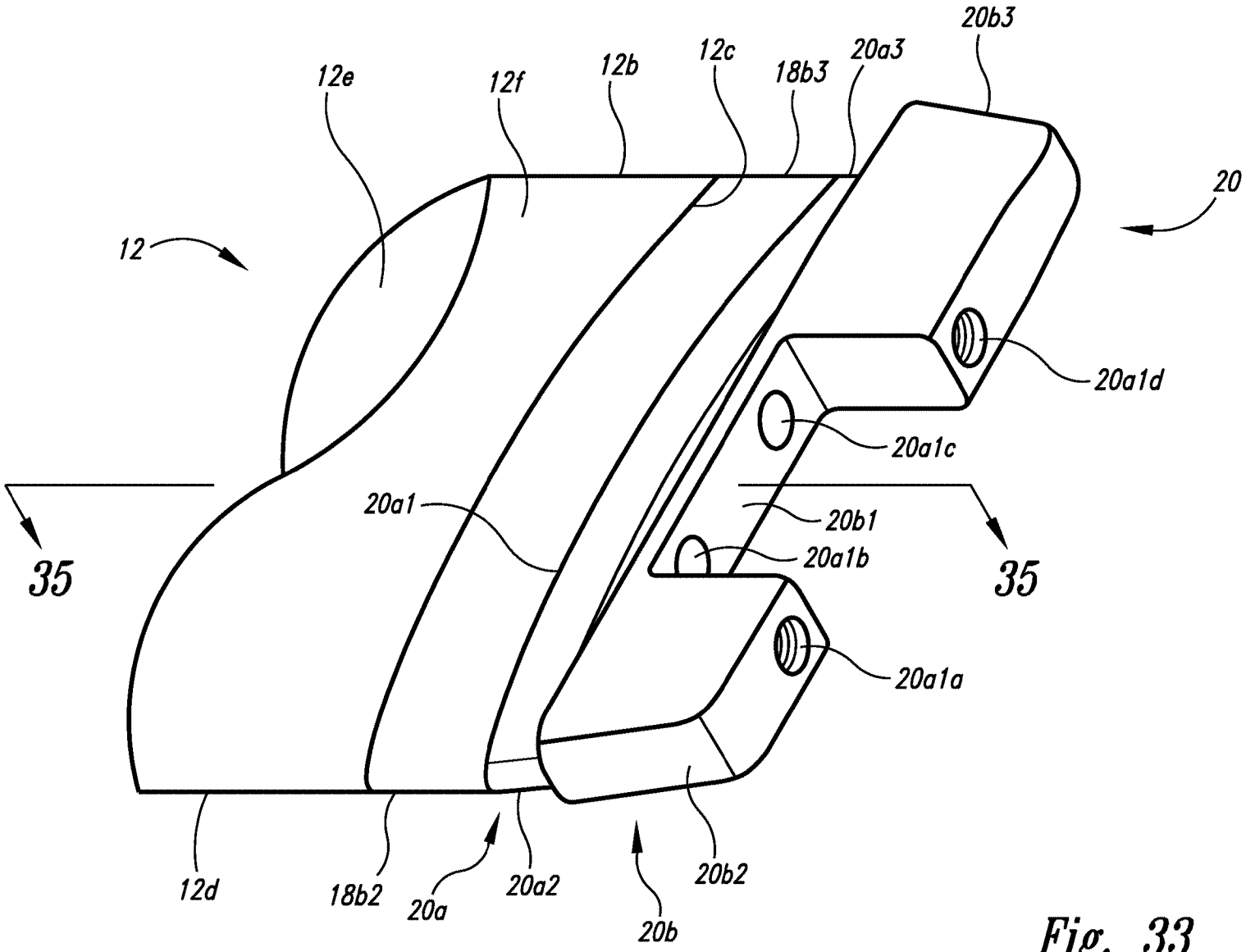
FIG. 33 is a front perspective view of the fuselage adapter of FIG. 3 coupled with the fuselage adapter insert of the mast assembly of FIG. 3 coupled with the mast of the mast assembly of FIG. 3.

Turning to FIG. 33, depicted therein is a front perspective view of fuselage adapter 20 coupled with fuselage adapter insert 18 of mast assembly 10 coupled with mast 12 of mast assembly 10.

Figure 34:
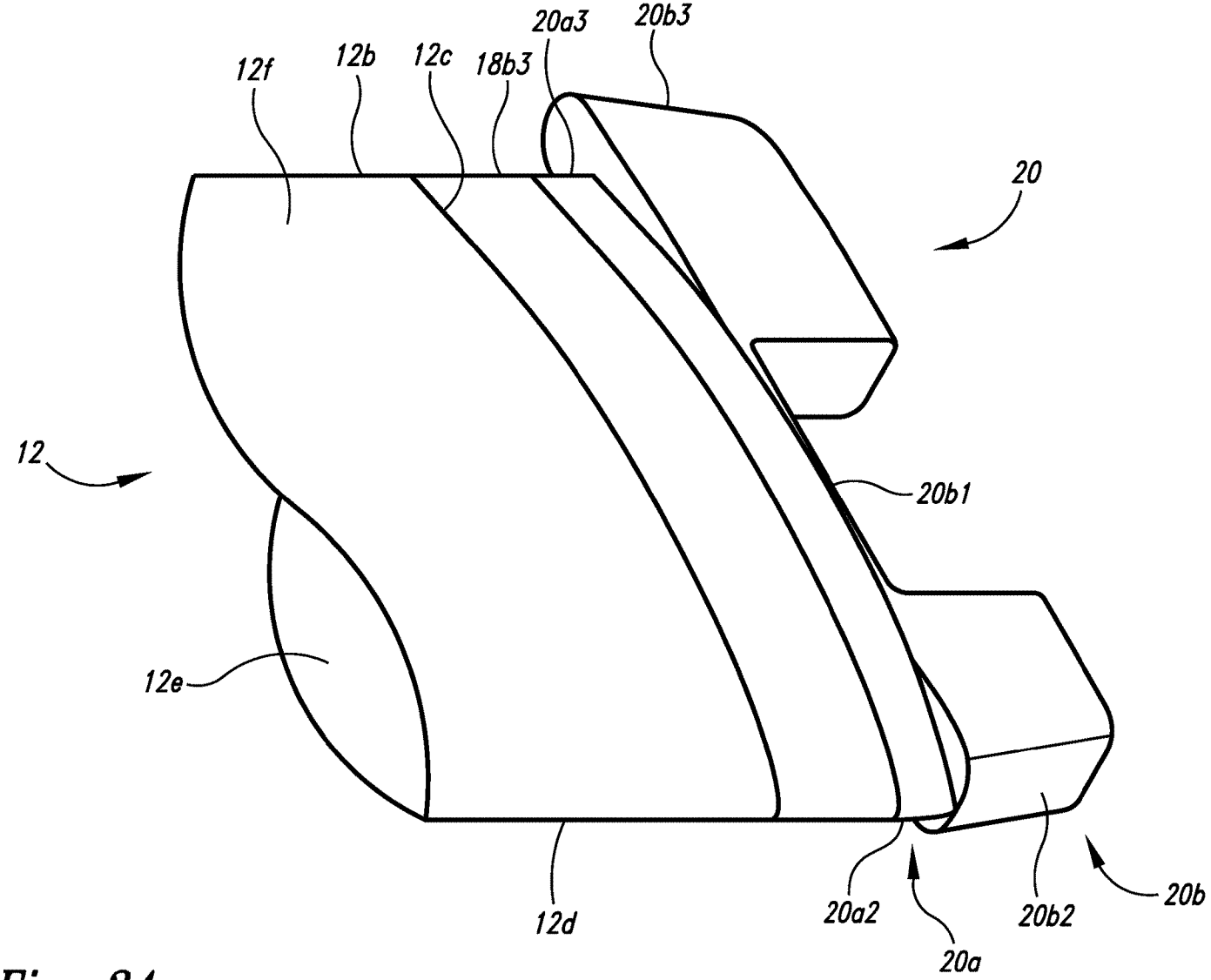
FIG. 34 is a rear perspective view of the fuselage adapter of FIG. 3 coupled with the fuselage adapter insert of the mast assembly of FIG. 3 coupled with the mast of the mast assembly of FIG. 3.

Turning to FIG. 34, depicted therein is a rear perspective view of fuselage adapter 20 coupled with fuselage adapter insert 18 of mast assembly 10 coupled with mast 12 of mast assembly 10.

Figure 35:
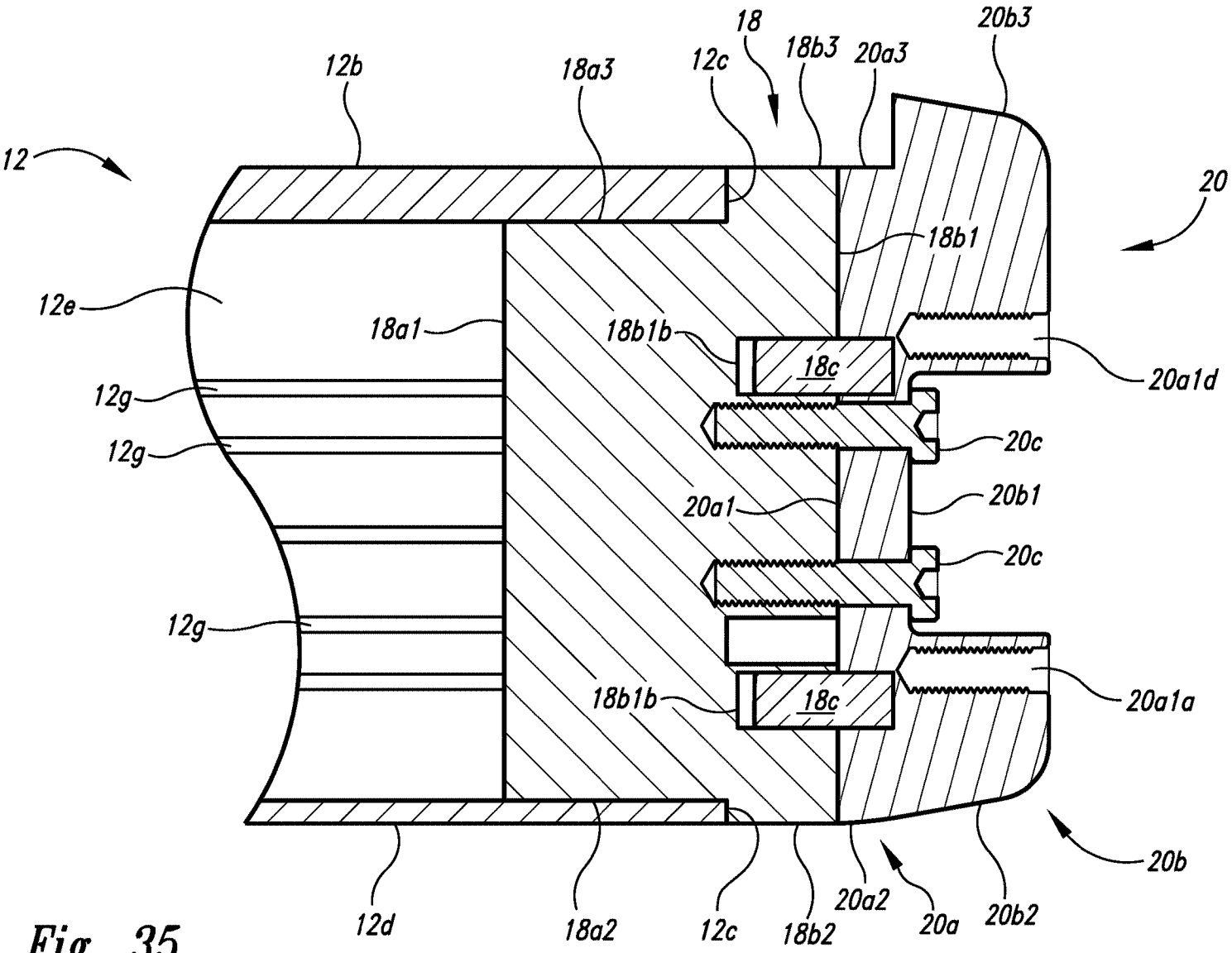
FIG. 35 is an elevational cross-sectional view of the fuselage adapter of FIG. 3 coupled with the fuselage adapter insert of the mast assembly of FIG. 3 coupled with the mast of the mast assembly of FIG. 3 taken along the 35-35 cut line of FIG. 33.

Turning to FIG. 35, depicted therein is an elevational cross-sectional view of fuselage adapter 20 coupled with fuselage adapter insert 18 coupled with mast 12 taken along the 35-35 cut line of FIG. 33.

Figure 36:
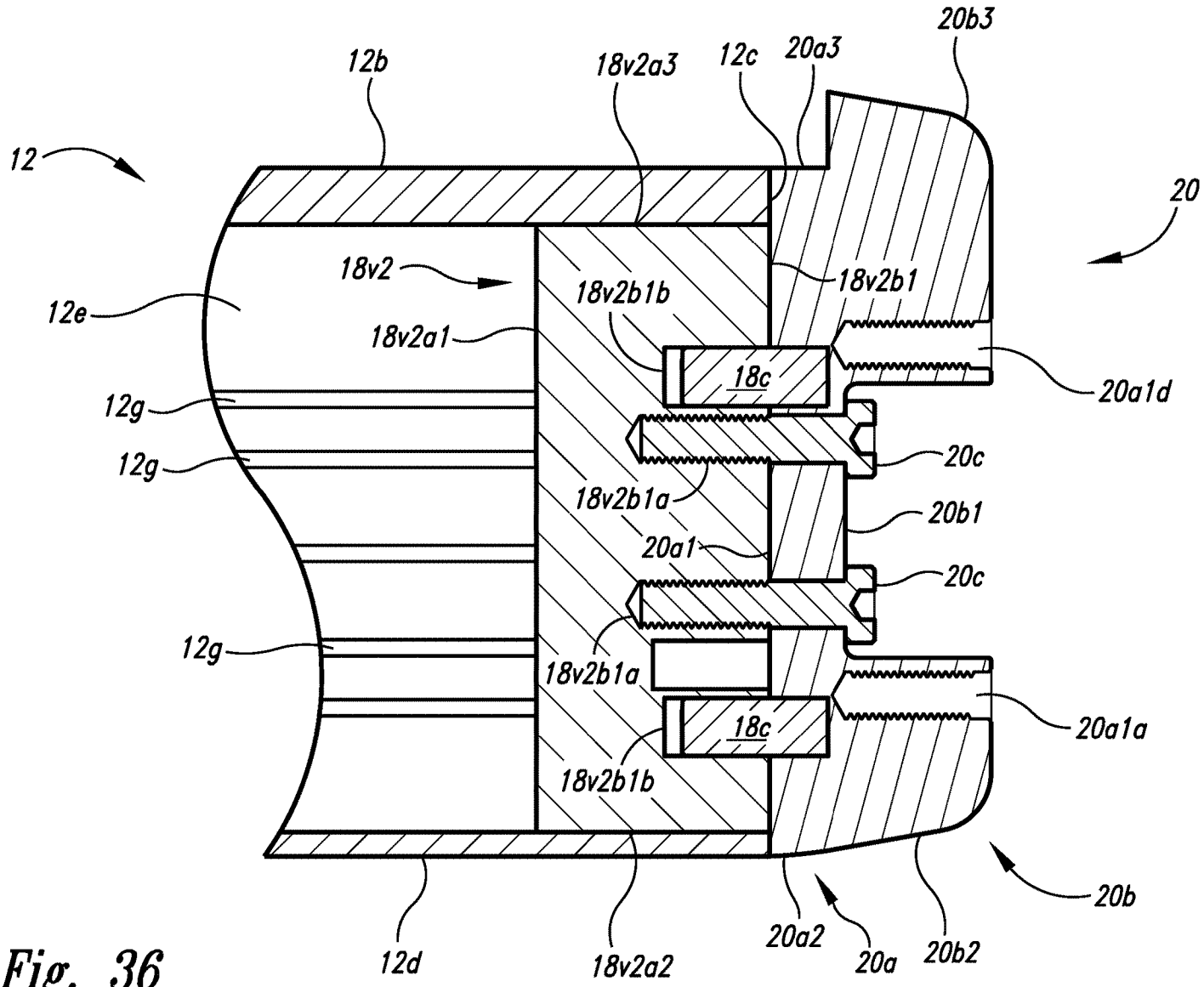
FIG. 36 is an elevational cross-sectional view of the fuselage adapter of FIG. 3 coupled with the second implementation of the fuselage adapter insert of FIG. 28 coupled with the mast of the mast assembly of FIG. 3.

Turning to FIG. 36, depicted therein is an elevational cross-sectional view of fuselage adapter 20 coupled with adapter insert 18*v*2 coupled with mast 12.

Figure 37:
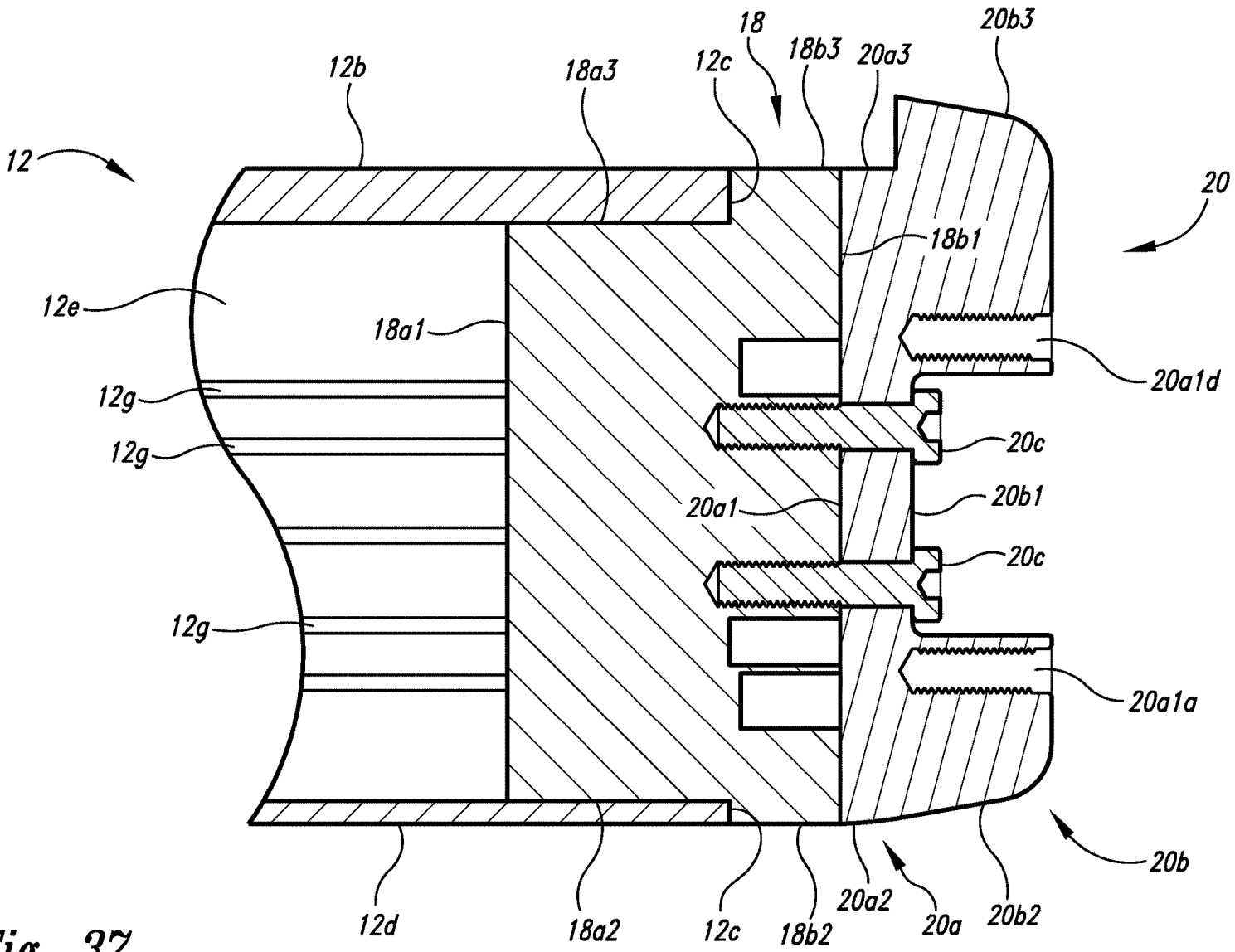
FIG. 37 is an elevational cross-sectional view of the fuselage adapter of FIG. 3 coupled with the fuselage adapter insert of the mast assembly of FIG. 3 coupled with the mast of the mast assembly of FIG. 3.

Turning to FIG. 37, depicted therein is an elevational cross-sectional view of fuselage adapter 20 coupled with fuselage adapter insert 18 coupled with mast 12.

Figure 38:
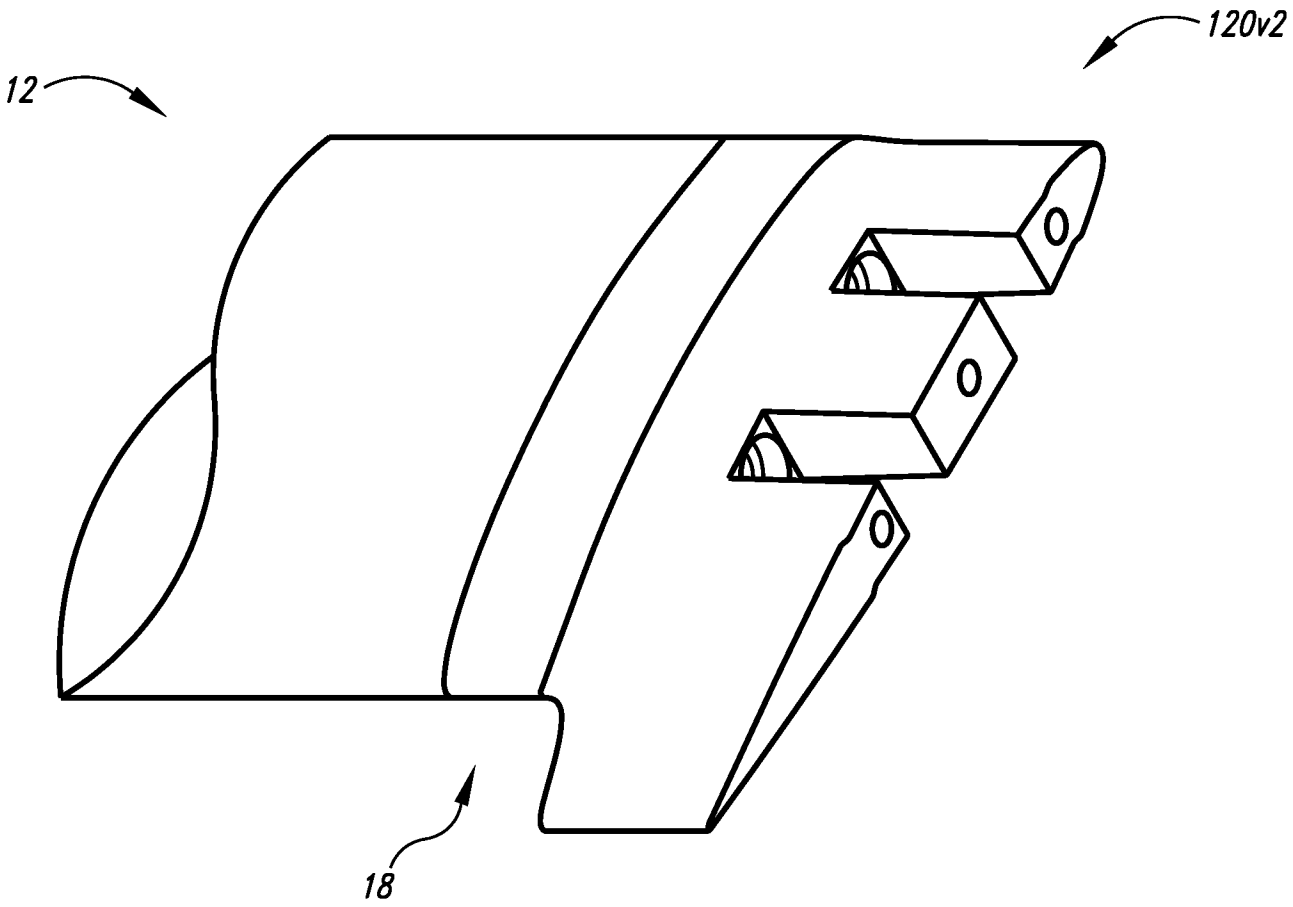
FIG. 38 is a front perspective view of a second implementation of a fuselage adapter.

Turning to FIG. 38, depicted therein is a front perspective view of a second implementation of fuselage adapter 20*v*2.

In implementations, fuselage adapter 20*v*2 is shown as one of many alternatives to mast coupler portion 20*a*.

Figure 39:
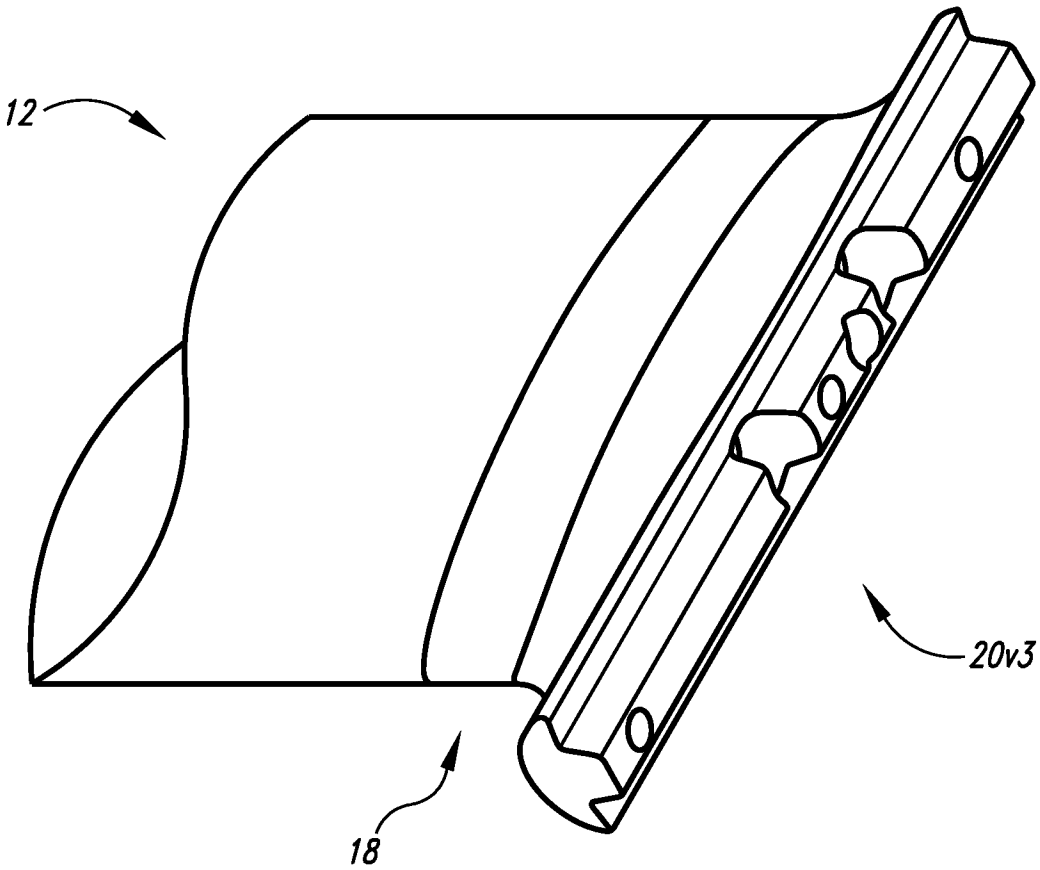
FIG. 39 is a front perspective view of a third implementation of a fuselage adapter.

Turning to FIG. 39, depicted therein is a front perspective view of a third implementation of fuselage adapter 20*v*3. In implementations, fuselage adapter 20*v*3 is shown as one of many alternatives to mast coupler portion 20*a*.

Figure 40:
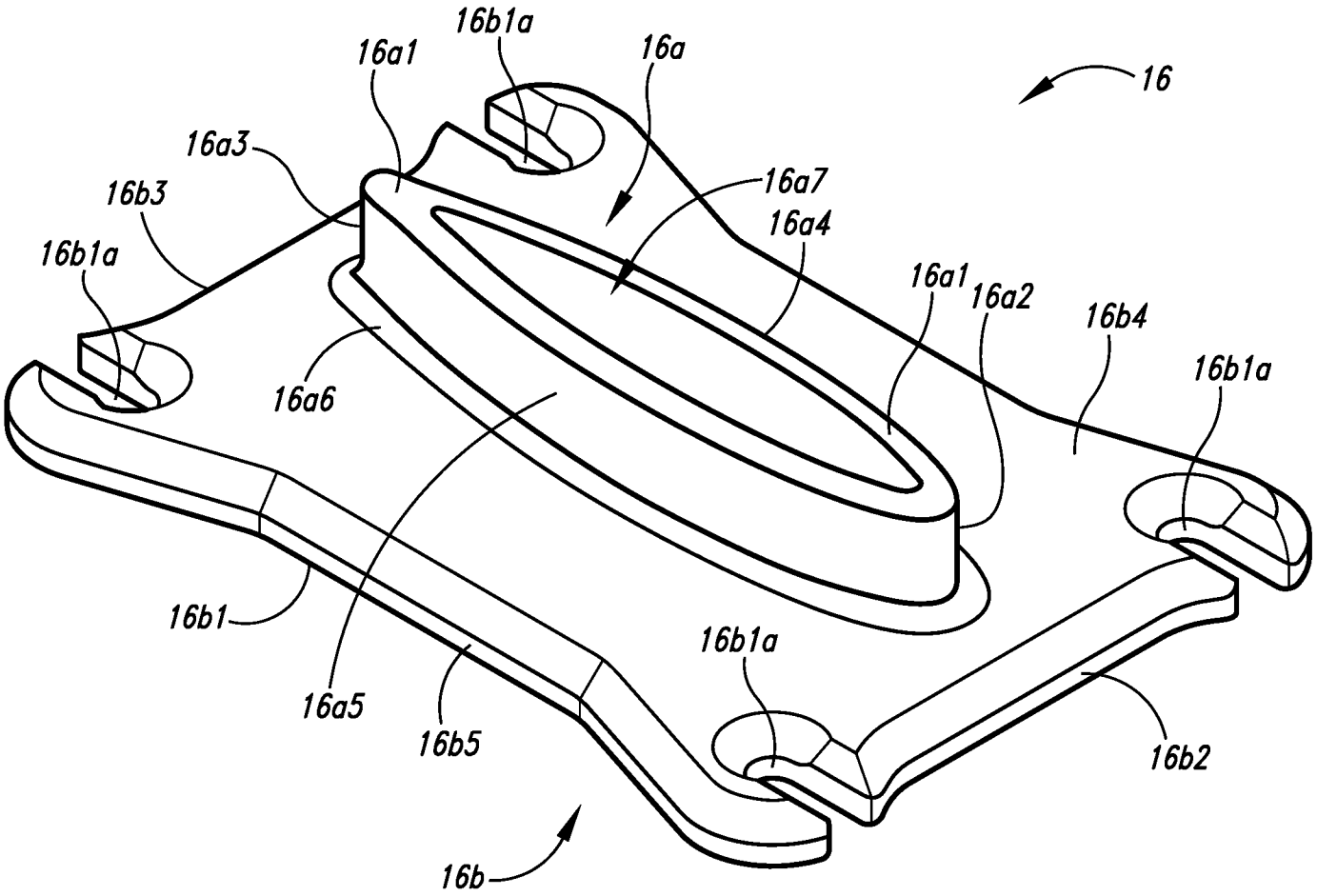
FIG. 40 is a rear perspective view of the watersports board mount of FIG. 3.

Turning to FIG. 40, depicted therein is a rear perspective view of watersports board mount 16. In implementations, receiver portion 16*a* of watersports board mount 16 is shown to include side portion 16*a*5, collar 16*a*6, and void 16*a*7. In implementations, board side 16*b*1 of flange portion 16*b* of watersports board mount 16 is shown to include threaded fastener hole 16*b*1*a*.

Figure 41:
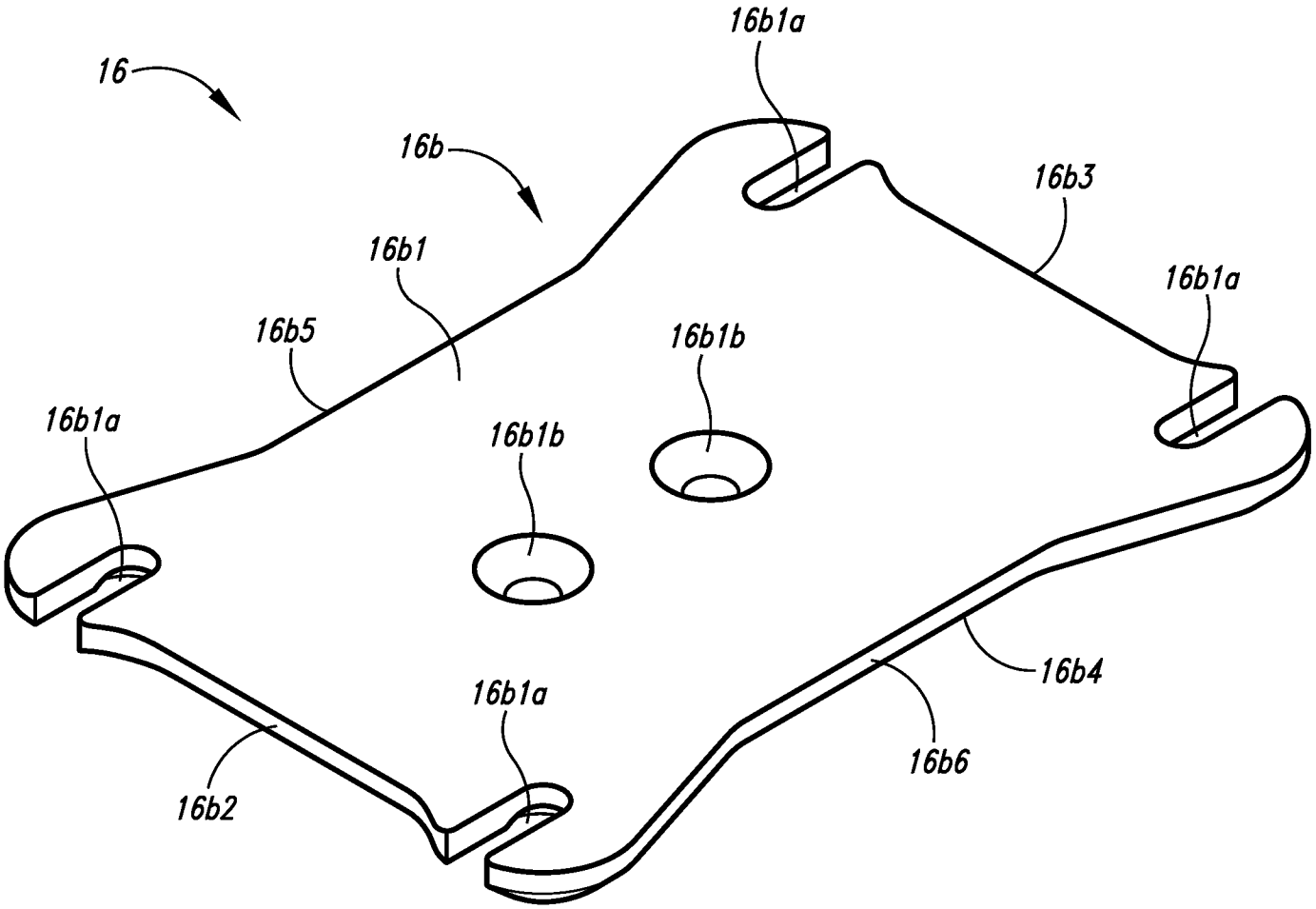
FIG. 41 is a front perspective view of the watersports board mount of FIG. 3.

Turning to FIG. 41, depicted therein is a front perspective view of watersports board mount 16. In implementations, board side 16*b*1 of flange portion 16*b* of watersports board mount 16 is shown to include threaded fastener hole 16*b*1*b*.

Figure 42:
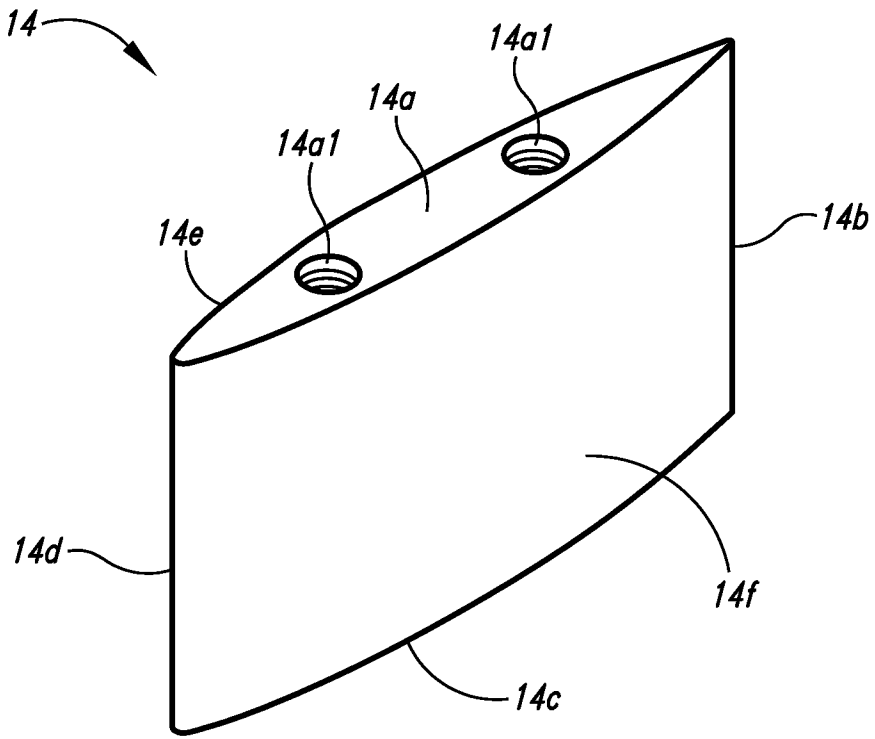
FIG. 42 is a front perspective view of the watersports board mount insert of the mast assembly of FIG. 3.

Turning to FIG. 42, depicted therein is a front perspective view of watersports board mount insert 14 of mast assembly 10. In implementations, board end 14*a* of watersports board mount insert 14 is shown to include threaded fastener hole 14*a*1. In implementations, watersports board mount insert 14 is shown to include side portion 14*f*.

Figure 43:
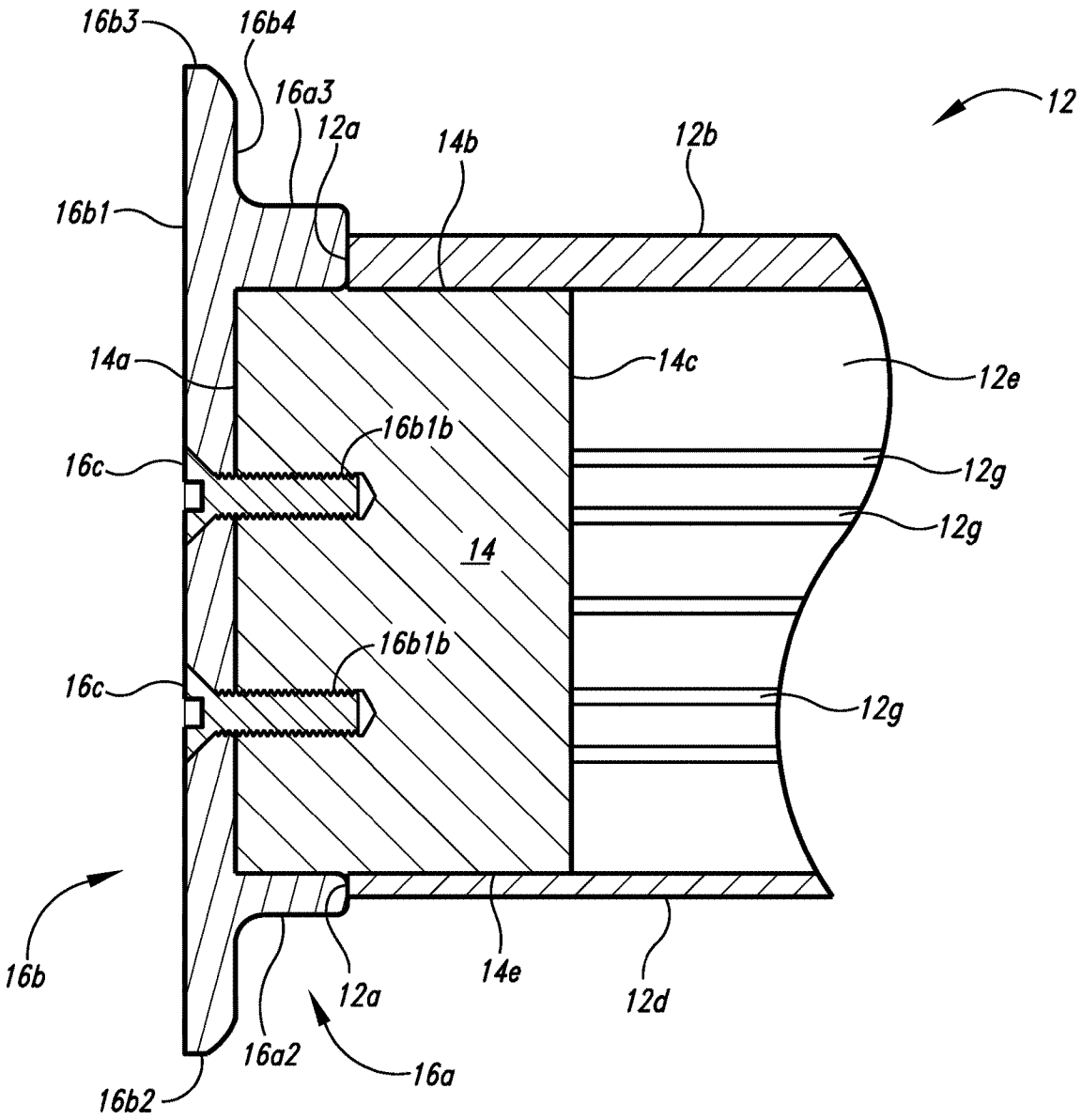
FIG. 43 is a side elevational cross-sectional view of the watersports board mount of FIG. 3 coupled with the watersports board mount insert of the mast assembly of FIG. 3 coupled with the mast of the mast assembly of FIG. 3.

Turning to FIG. 43, depicted therein is a side elevational cross-sectional view of watersports board mount 16 coupled with the watersports board mount insert of the mast assembly of FIG. 3 coupled with the mast of the mast assembly of FIG. 3. In implementations watersports board mount insert 14 as machined as an aluminum insert can coupled with the mast 12 by press-fitting into board end 12*a* of mast 12. In implementations watersports board mount insert 14 can be machined with tighter tolerances than mast 12. In implementations watersports board mount insert 14 can be adhesively bonded with board end 12*a* of mast 12. Although watersports board mount insert 14 is shown extending past board end 12*a* of mast 12, in implementations watersports board mount insert 14 can be flush or sub-flush with board end 12*a* of mast 12.

Figure 44:
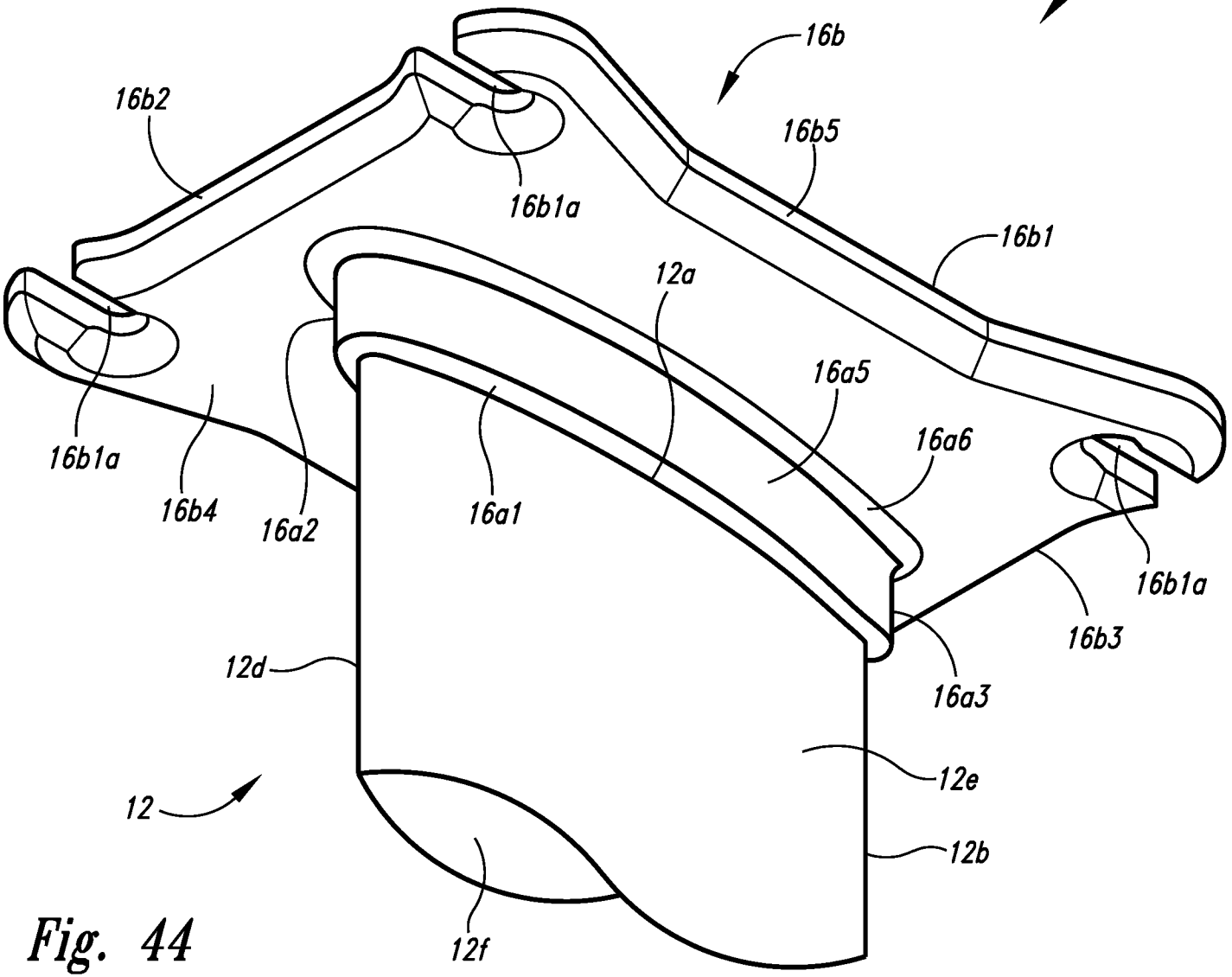
FIG. 44 is a perspective view of the watersports board mount of FIG. 3 coupled with the mast assembly of FIG. 3.

Turning to FIG. 44, depicted therein is a front perspective view of watersports board mount 16 coupled with mast 12 of mast assembly 10.

Figure 45:
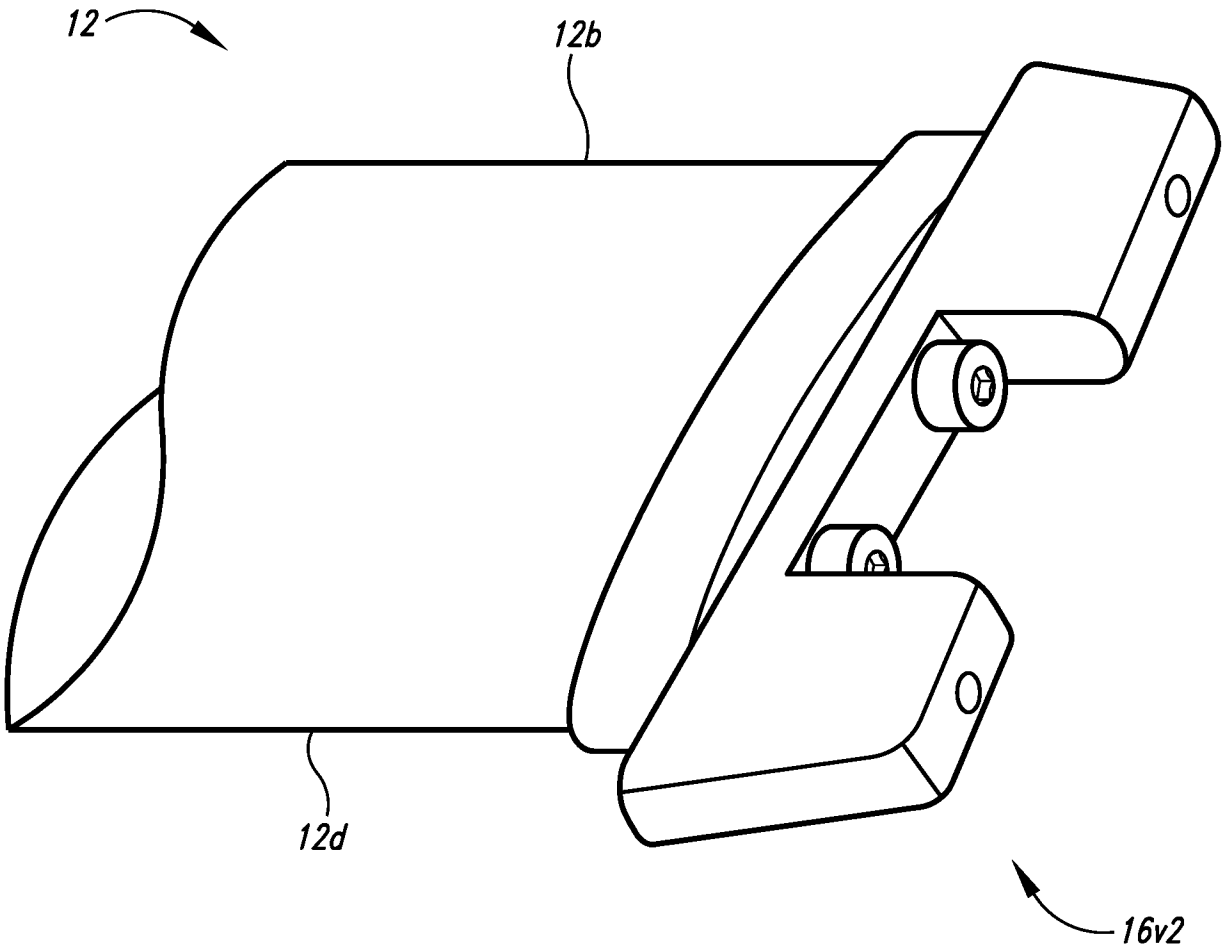
FIG. 45 is a perspective view of an alternative watersports board mount coupled with the mast assembly of FIG. 3.

Turning to FIG. 45, depicted therein is a perspective view of watersports board mount 16*v*2 coupled with mast 12.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A hydrofoil watersports system comprising:

(I) a hydrofoil mast including a fuselage end, a board end, at least one length dimension extending between the fuselage end and the board end, a plurality of width dimensions extending orthogonal to the at least one length dimension, the plurality of width dimensions being smaller than the at least one length dimension, and at least one thickness dimension extending orthogonal to the at least one length dimension and orthogonal to the plurality of width dimensions, the at least one thickness dimension being smaller than the plurality of width dimensions; and (II) a lower assembly including a hydrofoil fuselage coupled to the fuselage end of the hydrofoil mast with a fastener, wherein the fastener extends into the hydrofoil mast along a longitudinal axis of the hydrofoil mast, the lower assembly further including at least one wing coupled to the hydrofoil fuselage, wherein the at least one length dimension includes a first length dimension and the plurality of width dimensions includes a first width dimension, a second width dimension, and a third width dimension, wherein the first width dimension being positioned less than a first length percentage of the first length dimension from the fuselage end, wherein the second width dimension being positioned less than a second length percentage of the first length dimension from the board end, wherein the third width dimension being positioned greater than a third length percentage of the first length dimension from the fuselage end and from the board end, wherein the third width dimension being greater than the first width dimension by at least a first width percentage of the first width dimension, and wherein the third width dimension being greater than the second width dimension by at least a second width percentage of the second width dimension.

2. The hydrofoil watersports system of claim 1 wherein the first length percentage being at least 25%, the second length percentage being at least 25%, and the third length percentage being at least 25%.

3. The hydrofoil watersports system of claim 2 wherein the plurality of width dimensions includes a maximum width dimension being greater than any other of the plurality of width dimensions, the maximum width dimension being positioned from the fuselage end and the board end at least the third length percentage.

4. The hydrofoil watersports system of claim 1 wherein the at least one length dimension being greater than 49 cm and less than 151 cm, the plurality of width dimensions being greater than 89 mm and less than 151 mm, and the at least one thickness dimension being greater than 9 mm and less than 21 mm.

5. The hydrofoil watersports system of claim 1 wherein the first width percentage of the first width dimension being at least 5%, and the second width percentage of the second width dimension being at least 5%.

6. The system of claim 1 wherein the first width percentage of the first width dimension being no greater than 75%, and the second width percentage of the second width dimension being no greater than 75%.

7. The hydrofoil watersports system of claim 1 wherein the hydrofoil mast is of at least one construction taken from the following list: single-piece construction, hydro-formed construction, extruded construction, aluminum construction, pressed construction, molded construction, and carbon construction.

8. The hydrofoil watersports system of claim 1 wherein the hydrofoil mast further includes at least one internal cavity, the internal cavity including at least one interior surface wall, and at least one stringer extending from a first of the at least one interior surface wall without extending from any other of the at least one interior surface wall, the at least one stringer extending at least partially along the at least one length dimension.

9. The hydrofoil watersports system of claim 1 wherein the hydrofoil mast includes at least one edge with at least one side profile, the plurality of width dimensions includes a maximum width dimension being greater than any other of the plurality of width dimensions, the plurality of width dimensions includes a minimum width dimension being smaller than any other of the plurality of width dimensions, the minimum width dimension positioned closer to the fuselage end than the maximum width dimension is positioned, the minimum width dimension positioned closer to the board end than the maximum width dimension is positioned, the plurality of width dimensions includes a portion of the plurality of width dimensions positioned along the length dimension between the maximum width dimension and the minimum width dimension, and the portion of plurality of width dimensions forming a portion of the at least one side profile along at least one edge of the hydrofoil mast, wherein the at least one edge of the hydrofoil mast is at least one of the following: a trailing edge and a leading edge.

10. The hydrofoil watersports system of claim 9 wherein the at least one side profile along the at least one edge of the hydrofoil mast includes is at least one portion of the following portions: at least one linear portion and at least one curvilinear portion.

11. A mast assembly for a hydrofoil watersports board system, the mast assembly comprising:

(I) a single-piece metallic mast including (A) at least one internal cavity, (B) a first end, including a first opening providing external access to a first internal cavity of the at least one internal cavity, (C) a second end, and (D) a plurality of dimensions including a length dimension, the length dimension extending between the first end and the second end, the length dimension being greater than any other of the plurality of dimensions;

(II) a metallic insert shaped and sized to be press-fit into a portion of the first internal cavity through the first opening, the metallic insert fully blocking the external access to the first internal cavity from the first opening when the metallic insert is press-fit into the portion of the first internal cavity through the first opening; and at least one threaded fastener, wherein the metallic insert includes at least one threaded hole, wherein the at least one threaded fastener being shaped and sized to couple with the at least one threaded hole, and wherein the at least one threaded fastener includes at least one stainless steel screw.

12. The mast assembly of claim 11, further including at least one non-threaded fastener, wherein the metallic insert includes at least one non-threaded hole, wherein the at least one non-threaded fastener being shaped and sized to couple with the at least one non-threaded hole, and wherein the at least one non-threaded fastener includes at least one stainless steel dowel pin.

13. The mast assembly of claim 11 wherein the metallic insert being without a flange, the metallic insert being flush with the first end when the metallic insert is press-fit into the portion of the first internal cavity through the first opening of the mast.

14. The mast of claim 11 wherein the single-piece mast is of at least one construction taken from the following list: hydro-formed construction, extruded construction, aluminum construction, and pressed construction.

15. A hydrofoil watersports system comprising:

(I) a hydrofoil mast including (A) a fuselage end, (B) a board end positioned opposite from the fuselage end along a length dimension, (C) a plurality of dimensions including the length dimension, the length dimension extending between the fuselage end and the board end, the length dimension being greater than any other of the plurality of dimensions, (D) an internal cavity including a first interior surface and an opposingly facing second interior surface, the first interior surface and the second interior surface extending along the length dimension, (E) at least one first stringer extending from the first interior surface without extending from the second interior surface, the at least one first stringer extending at least partially along the length dimension, and (F) at least one second stringer extending from the second interior surface without extending from the first interior surface, the at least one second stringer extending at least partially along the length dimension; and (II) a lower assembly including a hydrofoil fuselage coupled to the fuselage end of the hydrofoil mast, the lower assembly further including at least one wing coupled to the hydrofoil fuselage.

16. The hydrofoil watersports system of claim 15 wherein the at least one first stringer is positioned at least 25 mm from the fuselage end and from the board end.

17. The hydrofoil watersports system of claim 15 wherein the hydrofoil mast is of a construction chosen from the following: single-piece construction, extruded aluminum construction, and pressed aluminum construction.

18. A hydrofoil watersports system comprising:

a hydrofoil mast assembly including (I) a hydrofoil mast including (A) a fuselage end including an exterior surface, and (B) a board end being positioned along a longitudinal direction from the fuselage end, and (II) at least one non-threaded dowel pin sized and shaped to couple with the fuselage end of the hydrofoil mast, a portion of the at least one non-threaded dowel pin being extended past the exterior surface of the fuselage end in the longitudinal direction opposite and away from the board end when the non-threaded dowel pin is being coupled with the fuselage end of the hydrofoil mast; and a lower assembly including a hydrofoil fuselage coupled to the fuselage end of the hydrofoil mast, the lower assembly further including at least one wing coupled to the hydrofoil fuselage.

19. The hydrofoil watersports system of claim 18, further including a metallic insert, wherein the fuselage end of the hydrofoil mast includes a cavity opening and wherein the metallic insert being press-fit into the cavity opening of the fuselage end of the hydrofoil mast, the metallic insert including at least one non-threaded hole sized and shaped to couple with the at least one non-threaded dowel pin when the non-threaded dowel pin is being coupled with the fuselage end of the hydrofoil mast.

20. The hydrofoil watersports system of claim 19, further including a fuselage adapter, the fuselage adapter coupled with the metallic insert at least in part by the at least one non-threaded dowel pin, the fuselage adapter coupled with the hydrofoil fuselage.

21. The hydrofoil watersports system of claim 18 wherein the at least one non-threaded dowel pin being of precision ground stainless steel manufacture.

22. The hydrofoil watersports system of claim 18 wherein the hydrofoil mast includes a cavity including at least one interior surface, and wherein the hydrofoil mast includes one or more stringers extending from a first of the at least one interior surface, extending along the longitudinal direction, and being positioned at least 25 mm from the fuselage end and the board end of the hydrofoil mast.

23. A hydrofoil watersports system comprising:

(I) a hydrofoil mast including a fuselage end, a board end, at length dimension extending between the fuselage end and the board end, a first width dimension extending orthogonal to the length dimension, the first width dimension being smaller than the length dimension, the first width dimension being located at the fuselage end, a second width dimension extending orthogonal to the length dimension, the second width dimension being smaller than the length dimension, the second width dimension being located at the board end, and a third width dimension extending orthogonal to the length dimension, the third width dimension being greater than the first width dimension and the second width dimension, the third width dimension being smaller than the length dimension, the third width dimension being located between the fuselage end and the board end, at least one thickness dimension extending orthogonal to the length dimension and orthogonal to the first width dimension, the second width dimension, and the third width dimension, the at least one thickness dimension being smaller than the first width dimension, the second width dimension and the third width dimension; and (II) a lower assembly including a hydrofoil fuselage coupled to the fuselage end of the hydrofoil mast with a fastener, wherein the fastener extends into the hydrofoil mast along a longitudinal axis of the hydrofoil mast, the lower assembly further including at least one wing coupled to the hydrofoil fuselage.

* * * * *